US009302800B2

(12) United States Patent
Holmes et al.

(10) Patent No.: US 9,302,800 B2
(45) Date of Patent: Apr. 5, 2016

(54) SYSTEM AND METHOD FOR FORMING FLUID MIXTURES

(71) Applicant: CNJFW & SON, LLC, Las Vegas, NV (US)

(72) Inventors: Kirk Holmes, Las Vegas, NV (US); Albert B. Cascia, La Mesa, CA (US); Damon Tran, San Diego, CA (US)

(73) Assignee: CNJFW & Son, LLC, Escondido, CA (US)

( * ) Notice: Subject to any disclaimer, the term of this patent is extended or adjusted under 35 U.S.C. 154(b) by 0 days.

(21) Appl. No.: 14/589,214

(22) Filed: Jan. 5, 2015

(65) Prior Publication Data

US 2015/0191266 A1 Jul. 9, 2015

Related U.S. Application Data

(60) Provisional application No. 61/924,107, filed on Jan. 6, 2014.

(51) Int. Cl.
*B65B 43/50* (2006.01)
*B67C 3/02* (2006.01)
(Continued)

(52) U.S. Cl.
CPC ..... *B65B 43/50* (2013.01); *A24F 47/008* (2013.01); *B65B 3/04* (2013.01); *B65B 3/28* (2013.01); *B65B 7/2835* (2013.01); *B65B 43/52* (2013.01);
(Continued)

(58) Field of Classification Search
CPC ..... B65B 39/14; B65B 39/145; B65B 43/62; B67C 3/02; B67C 3/023; B67C 3/026
USPC ..... 141/100–104, 144–152, 250, 259, 279, 141/284; 222/144; 700/233, 239; 53/276, 53/282, 471
See application file for complete search history.

(56) References Cited

U.S. PATENT DOCUMENTS 4,054,145 A 10/1977 Berndt et al.
4,077,444 A 3/1978 Gilson et al.
(Continued)

FOREIGN PATENT DOCUMENTS

EP 1 543 844 A2 6/2005
EP 2 659 794 A1 11/2013

OTHER PUBLICATIONS

Two screenshots (2 pages) from Internet website www.filamatic.com; Apr. 7, 2015.

*Primary Examiner* — Timothy L Maust
*Assistant Examiner* — Timothy P Kelly
(74) *Attorney, Agent, or Firm* — Rod D. Baker

(57) ABSTRACT

A fluid management and dispensing system and method. The system is used to at least partially fill containers with fluids according to a recipe. The filled containers may then be used in conjunction with, for example, "vaping" devices (e.g., electronic cigarette devices) to provide desired flavors to a consumer. The system includes a rotatable turret assembly with nozzles, a rotational motor, and a linear actuator. A container to be filled is positioned at a delivery station. The system can actuate the rotational motor to rotate the turret assembly to a desired circumferential location. The system can actuate the linear actuator to translate the turret assembly to a desired lateral location. After a particular nozzle of the turret assembly is aligned with a container, the fluid can be dispensed into the container. The dispensing system may be connected to a network, which may provide recipes for the fluid mixtures.

33 Claims, 18 Drawing Sheets

(51) Int. Cl.

| | |
|---|---|
| ***A24F 47/00*** | (2006.01) |
| ***B65B 3/04*** | (2006.01) |
| ***B65B 43/52*** | (2006.01) |
| ***B65B 3/28*** | (2006.01) |
| ***B65B 7/28*** | (2006.01) |
| ***G07F 13/06*** | (2006.01) |
| ***G07F 13/10*** | (2006.01) |
| *B65B 39/00* | (2006.01) |

(52) U.S. Cl.
CPC . *B67C 3/02* (2013.01); *G07F 13/06* (2013.01); *G07F 13/10* (2013.01); *B65B 2039/009* (2013.01); *B65B 2220/14* (2013.01)

(56) References Cited

U.S. PATENT DOCUMENTS

| | | | | |
|---|---|---|---|---|
| 5,078,302 | A | 1/1992 | Hellenberg | |
| 5,207,735 | A | 5/1993 | Furmanski | |
| 5,507,410 | A | 4/1996 | Clark et al. | |
| 6,793,387 | B1 | 9/2004 | Neas et al. | |
| 6,807,973 | B2 * | 10/2004 | Fratello | B60S 3/04 134/123 |
| 7,114,535 | B2 | 10/2006 | Hartness et al. | |
| 7,367,170 | B2 | 5/2008 | Hafker et al. | |
| 7,409,971 | B2 | 8/2008 | Bonatti et al. | |
| 7,513,279 | B2 | 4/2009 | Bernhard et al. | |
| 7,565,818 | B2 | 7/2009 | Thomas et al. | |
| 7,597,105 | B2 | 10/2009 | Barnes et al. | |
| 7,987,858 | B2 | 8/2011 | Sinclair, Jr. | |
| 8,141,596 | B2 | 3/2012 | Bartholomew et al. | |
| 8,308,623 | B2 | 11/2012 | Nelson et al. | |
| 8,386,072 | B1 | 2/2013 | Mihalik et al. | |
| 8,794,275 | B2 | 8/2014 | Gruber et al. | |
| 2003/0062379 | A1 * | 4/2003 | Bartholomew | A45D 44/00 222/1 |
| 2005/0150191 | A1 | 7/2005 | Taylor | |
| 2006/0120835 | A1 | 6/2006 | Pressman et al. | |
| 2008/0206751 | A1 | 8/2008 | Squirrell et al. | |
| 2008/0271812 | A1 | 11/2008 | Stefanello et al. | |
| 2011/0073215 | A1 | 3/2011 | Walz | |
| 2011/0277871 | A1 | 11/2011 | Trebbi et al. | |
| 2011/0293391 | A1 | 12/2011 | Bernhard | |
| 2012/0018034 | A1 | 1/2012 | Bertoli et al. | |
| 2012/0152406 | A1 | 6/2012 | Bartholomew et al. | |
| 2012/0325368 | A1 | 12/2012 | Strangis | |
| 2013/0158704 | A1 | 6/2013 | Hughes et al. | |
| 2013/0228187 | A1 | 9/2013 | Yisha | |
| 2013/0280024 | A1 | 10/2013 | Talmer et al. | |
| 2013/0320237 | A1 | 12/2013 | Cadieux et al. | |
| 2014/0271060 | A1 | 9/2014 | Le Roux | |
| 2014/0283946 | A1 | 9/2014 | Kribs | |

* cited by examiner

SYSTEM AND METHOD FOR FORMING FLUID MIXTURES

CROSS REFERENCE TO RELATED APPLICATIONS

This application claims the benefit of the filing of U.S. Provisional Patent App. Ser. No. 61/924,107 filed 6 Jan. 2014 and entitled "System and Method for Forming Fluid Mixtures," the entire specification of which is incorporated herein by reference.

BACKGROUND OF THE DISCLOSURE

1. Field of the Invention

The inventions relate to systems, apparatus, and methods for dispensing fluids, and, more particularly, for controllably dispensing and mixing multiple fluids, such as flavored fluids for use in electronic cigarettes, in a container.

2. Description of the Related Art

Fluid delivery or dispensing systems can be used in a variety of fields to dispense fluids, such as liquids, into containers to be sold to consumers. For products that are made from multiple fluids according to recipes, fluid dispensing systems typically utilize various mixing devices to dispense fluids into the container and mix them according to the particular recipe. It can be desirable to reliably dispense and mix multiple fluids as quickly as possible to improve throughput and to reduce delivery times to the consumer. Further, typical fluid delivery systems may be fairly large and occupy a large space. For example, large-scale distributors may include long assembly lines in warehouses to bottle and distribute large quantities of fluid. Such systems may include multiple auxiliary stations to prepare and label the containers for distribution. It can be desirable to provide fluid delivery systems over smaller footprints, while still maintaining various auxiliary functions.

An example of a device that uses various types of fluids is an electronic vaping device called an electronic cigarette, or e-cigarette. It is generally believed that regular cigarettes or cigars filled with tobacco can cause numerous health problems, such as cancer and heart disease. Some experts believe that e-cigarettes may be used as a potentially healthier alternative to smoking regular cigarettes that produce smoke by combustion of tobacco and/or other ingredients. In an e-cigarette, a fluid (e.g., liquid) solution may be vaporized by a heating element coupled to or integrated with a body of the e-cigarette. For example, in some cases, the fluid may include nicotine and other flavors designed to taste and/or smell desirable to a user. The vapor from the fluid can be inhaled by the user to simulate the smoking of regular tobacco cigarettes, cigars, pipes, etc. It is believed that the vapor from e-cigarettes may be healthier than the smoke produced when tobacco is burned. For example, the vapor may include fewer carcinogens and other unhealthy chemicals, which may improve health outcomes for users of e-cigarettes as compared to users of traditional cigarette or tobacco products. A desirable feature of e-cigarettes is the ability to use different fluid mixtures to produce vapor having different flavors, to suit the preferences of consumers.

Some previous disclosures that provide helpful background to the present disclosure include U.S. Pat. No. 7,513,279 to Bernhard, et al., U.S. Pat. No. 7,114,535 to Hartness et al., U.S. Pat. No. 8,141,596 to Bartholomew et al., U.S. Patent Application Publication No. 20011/0073215 by Walz, U.S. Pat. No. 8,794,275 to Gruber et al., U.S. Patent Application Publication No. 2011/0277871 by Trebbi et al., U.S. Pat. No. 7,409,971 to Bonatti et al., U.S Patent Application Publication No. 2008/0271812 by Stefanello, et al., and U.S. Patent Application Publication No. 2012/0325368 by Strangis. The entire disclosures of these previous publications are incorporated herein by reference.

Accordingly, it can be desirable to improve the dispensing, mixing, bottling, and other aspects of fluids, such as those used in e-cigarette devices.

SUMMARY OF THE DISCLOSURE

In a preferred embodiment, a fluid management system is disclosed. The fluid management system can comprise a fluid dispensing system. The fluid dispensing system may comprise a housing and a turret assembly disposed in the housing. The turret assembly can comprise a turret having one or more outlets configured to dispense fluid there through. The fluid dispensing system can also include one or more dispensing stations adapted to receive a container to be at least partially filled by fluid passing through the one or more outlets. An actuation assembly can be configured to substantially align a selected outlet of the one or more outlets with the container when the container is positioned at a first dispensing station of the one or more dispensing stations. A conveyance system can be configured to move containers through the one or more dispensing stations. A controller can be configured to control the operation of one or more of the turret assembly, the actuation assembly, and the conveyance system.

In another embodiment, an apparatus for dispensing fluid is disclosed. The apparatus can comprise a turret assembly configured to rotate about a rotational axis. The turret assembly can comprise a turret having a plurality of outlets configured to dispense fluid there through. A rotational motor can be adapted to rotate the turret assembly about the rotational axis. A linear actuator can be adapted to translate the turret assembly along a lateral axis, the lateral axis transverse to the rotational axis.

In yet another embodiment, a turret assembly configured to dispense fluid is disclosed. The turret assembly can comprise a disc-shaped turret having a central region and a peripheral region along a boundary of the turret. The turret can have a plurality of apertures formed there through. A plurality of outlets can be disposed at corresponding apertures and spaced apart in a pattern across the turret. The pattern can comprise a two-dimensional array of outlets, the two-dimensional array disposed between the central region and the peripheral region. An inlet end of each outlet can be configured to couple to a tube extending from a fluid storage reservoir to a first side of the turret. An outlet end of each outlet is configured to dispense the fluid away from a second side of the turret, the first side opposite the second side.

In another embodiment, a method for dispensing fluid into a container is disclosed. The method can comprise positioning a container at a dispensing station. A first fluid to be dispensed into the container can be selected. A first nozzle from a plurality of nozzles can be selected. The first nozzle can be coupled to a turret assembly having a rotational axis. The first nozzle can be in fluid communication with the first fluid. The method can further comprise rotating the turret assembly about the rotational axis to a first circumferential position to substantially circumferentially align the first nozzle with the dispensing station. The method can also comprise translating the turret assembly to a first lateral position along a lateral axis to substantially laterally align the first nozzle with the dispensing station. The first fluid can be dispensed into the container.

In yet another embodiment, a fluid management system is disclosed. The fluid management system can comprise a plurality of fluid reservoirs and a plurality of fluid outlets. Each fluid reservoir can be in fluid communication with a corresponding fluid outlet. The fluid management system can also include a controller in communication with the fluid outlets. The controller can be configured to receive recipe instructions from a user interface, the recipe instructions comprising a recipe selected by a user. The controller can be configured to process the recipe instructions to determine amounts of each ingredient to be used in the recipe. The controller can further be configured to determine whether or not sufficient ingredients are available. In addition, the controller can be configured to communicate with the user interface to send to the user interface a signal indicative of whether the system includes sufficient ingredients required for the recipe.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught or suggested herein without necessarily achieving other objects or advantages as may be taught or suggested herein.

All of these embodiments are intended to be within the scope of the invention herein disclosed. These and other embodiments will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

Various aspects and others of some embodiments will be apparent from the following description of preferred embodiments and the accompanying drawings, which are not necessarily to scale and are meant to illustrate and not to limit the invention. Like reference numerals refer to like parts throughout. In the drawings.

DETAILED DESCRIPTION OF DISCLOSED EMBODIMENTS

Figure 1A:
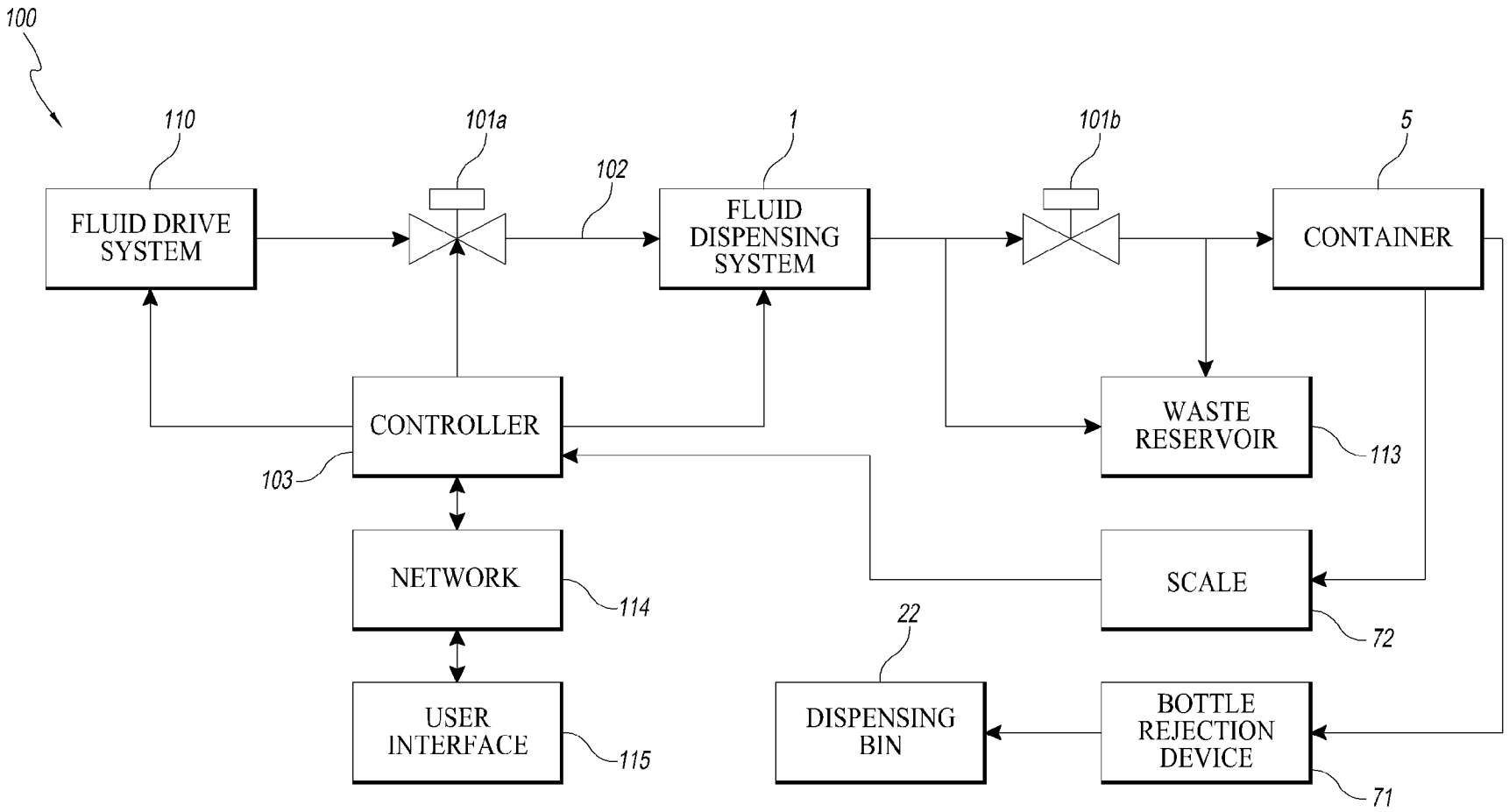
FIG. 1A is a schematic system diagram of a fluid management system, according to some embodiments.

Various embodiments disclosed herein relate to a fluid dispensing system including an apparatus and an associated method. The system finds practical utility in a variety of settings, including the customized mixing of liquids for dispensing into cartridge containers for use in electronic cigarettes. However, the utility of the disclosed system is not so limited, and it may find beneficial application in other circumstances where it is desired to mix fluids, particularly into a mixture according to a preselected recipe, or a permissive variable recipe, and to dispense the custom mixture into one or more containers. The system can be of a selected practical size, and may be scaled to be positioned upon a countertop and/or shelf, such as may be provided in a retail store such as an e-cigarette smoke shop, or at some other convenience location.

In some arrangements, it can be desirable to mix numerous fluids into a container according to a desired recipe. For example, in fluids used with electronic cigarettes (e-cigarettes), it may be desirable to the user for the fluid to include numerous flavoring liquids, their carriers and, optionally, nicotine or other active ingredient(s). The use of numerous liquids for e-cigarette devices enables the formulation and creation of complex flavors selected by the user, other users, or the distributor of the fluid containers. For example, in some embodiments, the user can select a pre-defined flavor, or the user can even create his or her own unique fluid mixture having a unique flavor. In view of the potentially numerous liquids that may be used in a particular recipe, it can be advantageous to provide a fluid dispensing system that accurately dispenses the appropriate volume of each liquid to the container in an efficient manner with a small footprint.

In some embodiments pertaining to use with e-cigarettes, the fluid that is vaporized by the e-cigarette can include any suitable number and type of liquid, and can be packaged in any suitable container, such as a bottle or cartridge. For example, in some e-cigarette devices, a pre-filled bottle can include a mixture of propylene glycol (PG), vegetable glycerin (VG), and/or other fluids. The bottle or container can be inserted into or otherwise coupled to the body of the e-cigarette, and the heating element can convert at least part of the fluid into a vapor, which can be inhaled by the user.

Furthermore, it can be advantageous to provide a system capable of managing the fluid lines used for dispensing numerous liquids. The fluid dispensing systems disclosed herein can include numerous tubes, with each tube configured to convey a different liquid to the container. For example, in some embodiments, tens, or hundreds, or more of different fluids may be available for dispensing into the container. It can be challenging to mechanically route the numerous fluid lines or tubes to a container positioned at a particular dispensing station. For example, the number of fluid lines or tubes can cause the tubes to become tangled, the tubes can interfere with other components of the system, and/or the tubes can become damaged or fail when subjected to external forces or stress. Moreover, it can be desirable for consumable fluid mixtures to be prepared, maintained and/or sealed in a sanitary environment (for example, a sterile environment) to guard against contamination from the external environment. In the disclosed system and apparatus, numerous tubes can be used separately to convey different fluids to a turret assembly without kinking the tubes, and yet to permit each tube to be brought controllably into association with a selected container, such that the fluid conveyed by a particular tube can be dispensed into the container.

In various embodiments disclosed herein, the system can advantageously include a turret assembly configured to manage the numerous fluid lines or tubes that carry the fluid from a fluid reservoir to the turret assembly. For example, the turret assembly can include a turret, which can be disc-shaped in some embodiments. The turret can include multiple apertures, and a plurality of outlets, such as nozzles, can be disposed near or through corresponding apertures. The nozzles can be disposed along the turret assembly in a pattern that minimizes the management of the bundle of fluid-carrying tubes.

For example, the nozzles can be formed in a pattern, including a pattern that groups together those nozzles associated with ingredients found to be in high demand, that prevents tangling or failure of the tubes. This minimizes rotational and translational motion of the turret assembly, and thus decreases processing time and reduces apparatus wear and tear. In some embodiments, the nozzles can be spaced apart across one side or face of the turret in a pattern that includes or defines a two-dimensional array of nozzles. The two-dimensional array can be disposed between a central region of the turret and a peripheral region of the turret. For example, in some embodiments, the pattern of nozzles can include multiple, circumferentially-spaced sets of nozzles, each set of nozzles comprising multiple, radially-spaced nozzles extending from the central region towards the peripheral region (e.g., in a spoke pattern). In some embodiments, the pattern of nozzles can include a hexagonal packing pattern in which each nozzle of the plurality of nozzles (except for, e.g., nozzles near boundaries of the array) is disposed adjacent and between six other nozzles. An inlet end of each nozzle can be configured to couple to a tube extending from the fluid storage reservoir to a first side of the turret, and an outlet end of each nozzle can be configured to dispense the fluid away from a second, opposite side of the turret. In some embodiments, the tubes can extend in a bundle vertically away from the first side of the turret, thereby providing a degree of slack that reduces strain on the tubes when the turret is rotated or otherwise moved. Accordingly, the embodiments disclosed herein can advantageously manage the routing of numerous flow tubes configured to dispense multiple fluids to a container.

Moreover, it can be challenging to control the dispensing of multiple fluids to the container, because the outlets for the fluid lines or tubes may be positioned away from the dispensing station where the container is positioned. The presently disclosed system addresses the challenge by providing means for rotating and means for linearly translating the turret assembly, such that any selected one of the fluid nozzles can be quickly and controllably aligned with a container to permit the corresponding fluid to be dispensed to the container. The means for rotating and means for linearly translating the turret assembly may feature an actuation assembly including a rotational motor and a linear actuator. Repeated rotation and/or translation of the turret permits any number of nozzles to be serially brought into alignment with a container, and as different nozzles are consecutively aligned with a given container, a customized mix of fluids can be provided in the container.

Thus in preferred embodiments, the system can include an actuation assembly and a controller configured to controllably dispense multiple fluids in the container. For example, the actuation assembly can include a rotational motor and a linear actuator. The rotational motor can be activated to rotate the turret assembly about a rotational axis. For example, the controller can determine a desired circumferential position for a selected nozzle or outlet, and the controller can instruct the rotational motor to rotate the turret assembly to the desired circumferential position. Rotating the turret assembly to the desired circumferential position (e.g., aligning the circumference of the turret assembly in a particular position so that a desired outlet aligns with a container) can enable the system to align the selected outlet with the container to be filled with a selected liquid. In some embodiments, the desired circumferential position can be substantially circumferentially aligned with the dispensing station and/or container.

Furthermore, in some embodiments, the linear actuator can be activated to translate the turret assembly to a desired location along a lateral axis, which may be transverse to the rotational axis of the turret assembly. For example, the controller can determine a lateral position corresponding to the location of the dispensing station or container, and the controller can instruct the linear actuator to translate the turret assembly to that lateral location. In some embodiments, the container can also be translated or moved to align the container with a selected outlet. When the selected nozzle is substantially aligned with the dispensing station and/or fluid container, a selected fluid can be dispensed into the container. Accordingly, various embodiments disclosed herein utilize a multi-axis (e.g., two-axis) actuation assembly that can align a nozzle selected from a plurality of nozzles with a dispensing station. By enabling the displacement and/or rotation of the turret assembly along and/or about multiple axes, the embodiments disclosed herein can provide for precise and accurate positioning of a suitable nozzle relative to the container and dispensing station.

It is seen, therefore, that the turret assembly can be controllably rotated about its axis of rotation, so that one or more nozzles located along a particular radius of the turret can be moved into radial alignment with a dispensing station or container. The turret may then be controllably translated linearly, as needed, to bring a single selected one of the one or more radially aligned nozzles into substantial registration with the container opening, to receive fluid from the single nozzle.

Accordingly, the embodiments disclosed herein advantageously provide systems, methods, and apparatus for controlling the dispensing of fluid. For example, in various embodiments disclosed herein, the system can receive a recipe from a user, a manufacturer, and/or a central server, and the system can determine which fluids should be dispensed into the container for that particular recipe. The system can position the container at a dispensing station and can select a first fluid to be dispensed into the container based on the recipe. The system can further select a first outlet or nozzle that is associated with, or in fluid communication with, the first fluid. The first outlet may be positioned away from the dispensing station. The system can determine an actuation sequence for aligning the first outlet with the dispensing station and the container that is to be at least partially filled with the first fluid. For example, the system can rotate the turret to which the first nozzle is coupled about a rotational axis. The system can also translate the turret along a lateral axis. When the first outlet or nozzle is substantially aligned with the dispensing station and container, the nozzle can be activated to at least partially fill the container with the first fluid. A scale or other measurement device can measure the amount of each fluid dispensed into the container to determine whether an adequate amount of the fluid has been supplied. This measurement can be performed after dispensing each liquid. The system can repeat this procedure for the other liquids to be used in the recipe (e.g., a second liquid, a third liquid, etc.).

Some known fluid dispensing systems are designed for large-scale production, and are housed in warehouses or other large structures. The manufacturer or bottler may bottle large numbers of pre-made fluid mixtures, which can be sold to consumers. The choice of fluid for the consumer may therefore be limited and determined by which fluids the manufacturer or bottler desires to make. Accordingly, it can be advantageous to enable the user to select, mix, or controllably adjust within set limits, desired flavors for the fluid mixtures. For example, in e-cigarette devices, it can be desirable for the user to make a desired recipe to generate desired flavors in the vapor. Further, it can be advantageous to provide the fluid dispensing system with a size that is relatively small and that covers a small footprint. For example, in some embodiments, the fluid dispensing system can be housed within a kiosk, vending machine, or other type of housing. The kiosk can be used in stores, markets, outdoor venues, or any other suitable location. In some embodiments, the fluid dispensing system may also be used in large-scale manufacturing or bottling facilities.

According to one embodiment of the presently disclosed system, a user can interact with the fluid dispensing system by way of a user interface. For example, in some embodiments, the user interface can be integrated with or coupled to the kiosk containing the fluid dispensing system, and the user can interact directly with the kiosk. In some embodiments, the user interface can be connected with the fluid dispensing system over a network, for example, over the Internet or a private network. Thus, the fluid dispensing system can be in data communication with the user interface via the network. The user can operate the user interface to select a desired flavor, or the user can create his or her own flavor. A controller of the kiosk can receive instructions from the user interface that include the recipe to be made for the user. The controller can be configured or programmed to manage the actuation assembly to dispense the appropriate amounts of each fluid of the recipe into the container. Once the container is at least partially filled with the appropriate ingredient fluids, the kiosk mixes the fluids itself; mixing is performed by the fluid dispensing system. The user can then optionally insert the fluid and/or fluid container into device, e.g., an e-cigarette device, and enjoy the unique flavor combinations enabled by the embodiments disclosed herein.

There is disclosed according to one embodiment, a fluid management system featuring a plurality of fluid reservoirs; a plurality of fluid outlets, each fluid reservoir in fluid communication with a corresponding fluid outlet; and a controller in communication with the fluid outlets, the controller configured to: receive recipe instructions from a user interface, the recipe instructions comprising a recipe selected by a user; process the recipe instructions to determine amounts of each ingredient to be used in the recipe; determine whether or not sufficient ingredients are available; and communicate with the user interface to send to the user interface a signal indicative of whether the system includes sufficient ingredients required for the recipe. The fluid management system preferably includes a user interface wherein the user interface is directly coupled to the fluid management system. The recipe instructions are received over a network (local or external), wherein the user interface comprises a terminal in data communication with the network.

It should be appreciated that, although some embodiments are discussed in the context of containers used with e-cigarette devices, the systems, methods, and apparatus disclosed herein can be used to dispense any suitable fluid for any suitable purpose. For example, in other embodiments, it can be desirable to dispense flavored drinks or other recipes that include multiple fluid-based ingredients. In some embodiments, the fluids to be dispensed can include suitable medications, pharmaceutical compounds, cosmetics, dyes, etc. For example, in some embodiments, the systems disclosed herein can dispense medicines such as acetaminophen, children's cold medicine, cough remedies, and various over-the-counter medications. In some embodiments, the system may be used to dispense flowable solids, such as beads or grains of solid material, that may be flowed through the outlets or nozzles from reservoirs containing the solid material. In the present disclosure, the fluids to be mixed typically are liquids, but "fluids" is intended to mean gasses and flowable pelletized/granulated solids as well.

Attention now is invited to FIG. 1A, schematically diagramming a fluid management system 100, according to the present disclosure. The fluid management system generally indicated at 100 may include a fluid drive system 110 and a fluid dispensing system 1. As discussed herein, multiple flexible and/or pliable fluid lines or tubes may couple the fluid drive system 110 to the fluid dispensing system 1 of the overall management system. For example, each of the tubes can be in fluid communication with an associated fluid storage reservoir in the fluid drive system 110, and the tubes thus can convey different liquids in various proportions to the fluid dispensing system 1 (thereby to dispense a desired fluid mixture into a container). FIG. 1A illustrates a schematic diagram for a single fluid line 102 of the plurality of flexible and/or pliable fluid lines or tubes. (The plurality of fluid tubes are not shown in FIG. 1A for the sake of clarity of illustration; the illustrated fluid line 102 is exemplary in FIG. 1A.) The fluid line 102 provides fluid communication between the fluid drive system 110 and the fluid dispensing system 1. It is noted that similar layouts may be provided for each tube of the plurality of tubes (such as, e.g., a bundle of tubes 3, described herein with respect to FIGS. 2A-4B). The fluid drive system 110 can be configured to pump or otherwise drive fluid through the fluid line 102 to the fluid dispensing system 1, for example by positive pressure applied to the fluid line 102 connected to (or otherwise in fluid communication with) the fluid drive system 110. In some other embodiments, fluid can be drawn through the fluid line 102 by negative pressure from the end of the fluid line 102 connected to (or otherwise in fluid communication with) the fluid dispensing system 1; in such an alternative embodiment, the fluid drive system 110 may be used primarily to house fluid reservoirs.

With continued reference to FIG. 1A, a first valve 101*a* can be disposed along the fluid line 102 between the fluid drive system 110 and the fluid dispensing system 1. The first valve 101*a* may be any suitable valve. In some embodiments, for example, the first valve 101*a* is a pinch valve. The first valve 101*a* may be controllably actuated such that fluid can be selectively conveyed from the fluid drive system 110, through the first valve 101*a*, and to the fluid dispensing system 1. For example, when a selected liquid is to be dispensed by the fluid dispensing system 1, the fluid line 102 that is in fluid communication with the selected liquid can be activated, and the first valve 101*a* can be opened such that the selected liquid flows from the fluid drive system 110 to the fluid dispensing system 1 by way of the fluid line 102 (which may correspond to a particular tube of the tube bundle 3 described herein with respect to FIGS. 2A-2B).

In typical usage, the fluid dispensing system 1 may be configured to dispense fluid into a container 5. In some preferred embodiments, the container 5 is a cartridge, and the fluid dispensing system 1 is configured to dispense flavored liquids into cartridges adapted to couple to a device for consuming the liquids, e.g., an e-cigarette device. In some other embodiments, the liquids may be consumable and can be consumed directly from the container, e.g., by an individual user.

A second valve 101*b* may be provided between the fluid dispensing system 1 (or may be part of the system 1) and the container 5. The second valve 101*b* can be actuated to permit fluid to flow from the system 1 into the container 5. The second valve 101*b* may be a known type of check valve. For example, when the fluid pressure differential across the second valve exceeds a certain valve threshold, the valve 101*b* may open to permit fluid to flow therethrough and into the container 5. In some embodiments, fluid may leak from the fluid dispensing system 1, or waste fluid may otherwise be generated. For example, fluid may leak from the outlets or nozzles of the system 1 before or after flowing through the second valve 101*b*, and a drip tray may be used to collect the waste fluid. Under such circumstances, a drain tube may be provided to convey the waste fluid to a waste reservoir 113.

The weight of the container 5 may be measured using any suitable scale 72 (FIG. 2E), such as a digital measurement scale (e.g., a load cell). The scale 72 can communicate with a controller 103, described herein, and the controller 103 can determine whether or not there is a confirmed accurate amount of desired fluid in the container. If there is an inaccurate (e.g., insufficient) amount of fluid, then the container 5 can be discarded by way of a bottle rejection device 71 (FIG. 2E), and another container can be filled instead. If there is a proper quantity of fluid in the container 5, then the filled container 5 can be transferred to a dispensing bin 22 to be dispensed to the end user for use/consumption. Accordingly, the scale 72 can be configured to measure and confirm the amount of each fluid of a particular recipe after the fluid is dispensed into the container 5.

The controller 103 preferably is configured to control the operation of one or more of the fluid drive system 110, the first valve 101*a*, the second valve 101*b*, and the fluid dispensing system 1. For example, the controller 103 preferably includes a processor and memory, and can be programmed according to known computer programming arts to control the various actions of the fluid management system 100 described herein, including activating the fluid drive system 110 to drive fluid along the fluid line 102. The controller 103 may also be programmed in some arrangements to open and close the first valve 101*a*. For example, the controller 103 can be instructed to determine which liquid(s) are to be dispensed into the container 5. The controller 103 can select the appropriate fluid line 102 associated with the liquid that will be dispensed into the container 5, and can actuate the corresponding first valve 101*a* to permit the selected liquid to flow from the fluid drive system 110, through the first valve 101*a*, and to the fluid dispensing system 1. The controller 103 can similarly close the first valve 101*a* to block fluid from flowing along the fluid line 102 to the fluid dispensing system 1.

The controller 103 moreover preferably can control the operation of the fluid dispensing system 1. For example, the controller 103 can control the operation of an actuation assembly, a turret assembly, and/or other components of the fluid dispensing system 1. It shall be appreciated that, while a single controller 103 is illustrated in FIG. 1A as being capable of controlling the operation of the fluid drive system 110, the first valve 101*a*, and the fluid dispensing system 1, skilled artisans would understand that multiple controllers may instead be used to drive the disclosed systems, and the controller 103 may be understood to schematically represent the aggregate of these controllers. It should further be noted that, while the controller 103 is illustrated in FIG. 1A as a separate unit, a skilled artisan will understand that the controller 103 can also act as, or be a part of, the user interface 115 described further herein below, and vice versa.

The fluid management system 100 preferably but optionally may also include a user interface 115. In some embodiments, the user interface 115 is integrated with the fluid dispensing system 1. The interface 115 normally is not operatively coupled to the fluid dispensing system 1 without the use of a controller 103. The associated use of a network 114 (explained below) is optional. For example, in some embodiments, the fluid management system 100 is implemented in a housing comprising a kiosk or other type of housing. In such embodiments, the user can operate the user interface 115 to select and/or purchase a desired fluid mixture to be dispensed in the container 5. For example, in such embodiments, the user interface 115 may include a touch-screen interface, and/or may include a keypad and display, according to interfaces known generally in the art. The user interface 115 may also include components to facilitate a sale at the kiosk, including, e.g., cash processing trays, cash receipt trays, credit card processing strips, picture credit card processing, etc.

In some other embodiments, the controller 103 (which may be part of a central computerized server) can be in data communication with the user interface 115 by way of an analog, or preferably digital, network 114. For example, the user interface 115 may include an electronic terminal, such as a personal computer, laptop computer, mobile "smartphone," tablet computer, etc. The user interface 115 can be implemented as an application on the terminal in some arrangements (such as an application on a "smartphone" or tablet computer), while in other arrangements, the user interface 115 can be accessed on a web site hosted on the World Wide Web. The network 114 can be a private network or can be the Internet. The user can operate/manipulate the user interface 115 to select or create a recipe. The user interface 115 can send instructions to the controller 103 regarding the recipe to be dispensed in the container 5 over the network 115. In some embodiments, the controller 103 can communicate over a wireless data network, such as over a WLAN, by Bluetooth, etc. Data signaled from the interface 115 may then be processed by the controller 103.

The controller 103 and/or server in data communication with the system over the network 115 preferably is/are configured to process the received recipe instructions to determine amounts of each ingredient to be used in the recipe. The controller 103 and/or server may determine whether or not sufficient ingredients are available in the system 100 for dispensing into the container for the selected recipe. The controller 103 and/or server can communicate with the user interface 115 (e.g., either directly, or via intermediary computing systems) by sending a signal indicating whether the system 100 includes sufficient ingredients for the selected recipe. If there are insufficient ingredients available in the system, the user interface 115 may be configured to display the geographical location of various particular systems 100 with sufficient ingredients, and to confirm with the user whether to proceed with making and dispensing of the recipe, and the location where the formulation can be found. The system optionally can be configured and programmed so that an end user is notified of a need or option to service the system 100 prior to the execution of the recipe.

Figure 1B:
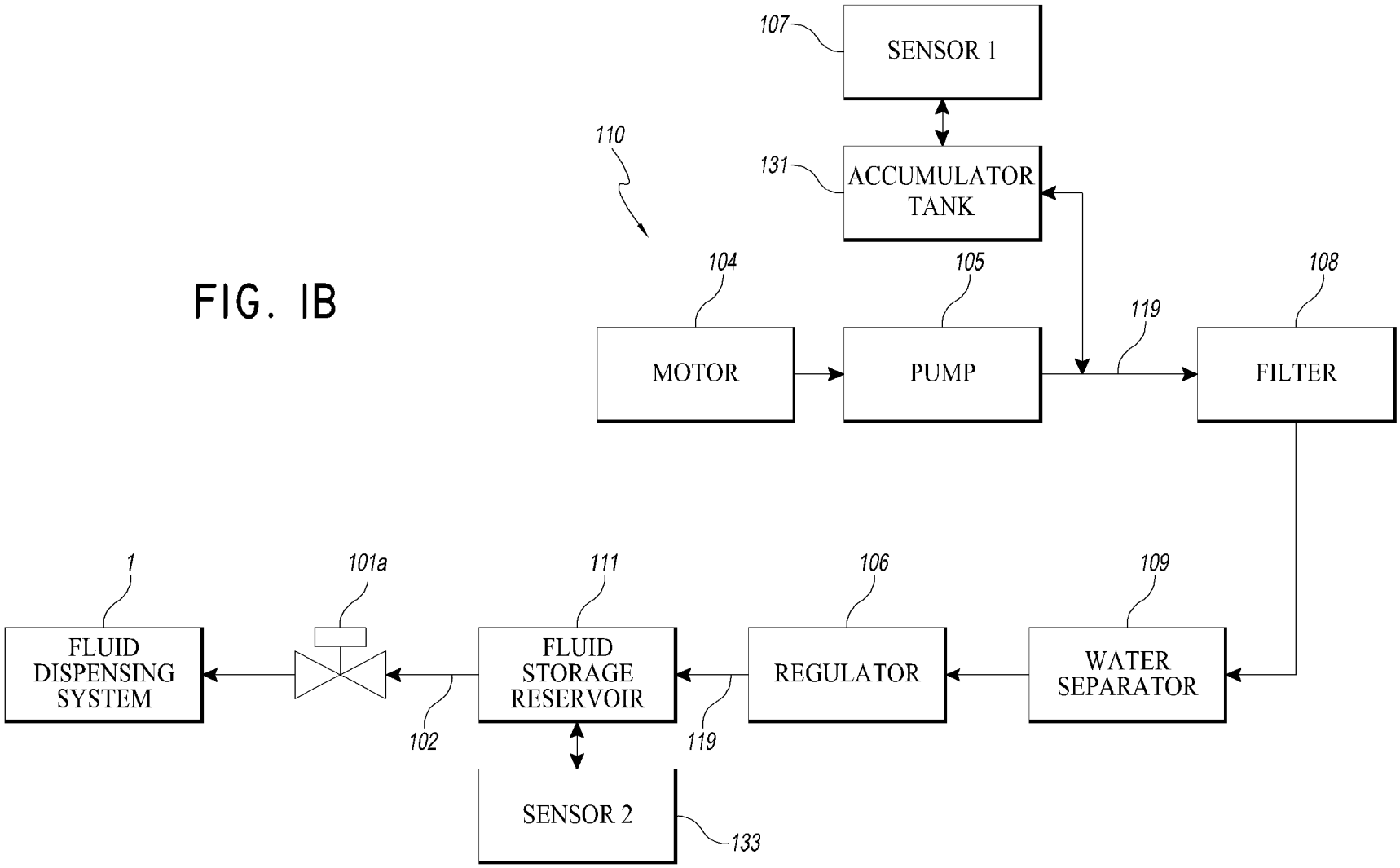
FIG. 1B is a schematic system diagram of a fluid drive system in fluid communication with a fluid dispensing system, in accordance with the embodiments of FIG. 1A.

Reference is made to FIG. 1B for a schematic system diagram of the overall fluid drive system 110 as it is in fluid communication with the fluid dispensing system 1 shown in FIG. 1A. The fluid drive system 110 is configured to drive the fluid through the fluid line 102 to the first valve 101*a* and the fluid dispensing system 1. The fluid drive system 110 may include a pump 105 powered by a suitable motor 104. The pump 105 optionally may feature an air compressor adapted to pressurize air to be passed along an air pressure supply line 119. The motor 104 can be any suitable electric motor such as an alternating current (AC) or direct current (DC) motor. The pump or compressor can be permanently lubricated or oil-free single or multi-piston motor driven, or the pump or compressor can comprise a diaphragm air fluid delivery system with or without its own storage tank. The system 110 can also include an accumulator tank 131 configured to receive and/or store air. The accumulator tank 131 can be connected to a tee-fitting that shares a common connection point to an outlet of the pump 105 and an inlet of the air pressure line 119. As also depicted by FIG. 1B, the pump 105, sensor 107, pressure regulator 106, and any other suitable components may be connected to the controller 103 and configured for remote control, diagnostics, duty cycle reporting, etc.

A sensor 107, such as a pressure sensor, may be provided to measure the air pressure in the accumulator tank 131. The sensor 107 can be configured to ensure that a minimum air pressure is maintained in the accumulator tank 131. Further, the sensor 107 may be configured to signal the prevention of the motor 104 from continuously operating the pump 105, such that a 100% duty cycle motor and pump need not be used. A filter 108 preferably may be provided downstream of the pump 105 to remove any debris that is entrained with the air supplied by the pump 105 (or stored by the accumulator tank 131). A water separator 109 may also be provided to remove water that may be entrained with the air.

A pressure regulator 106 may be provided downstream of the water separator 109, and can be configured to regulate the pressure of the air passing through the regulator 106. Situating the regulator 109 downstream of the filter and water separator 109 may prevent regulator failure by preventing debris and water residue from entering the regulator 106. The pressure regulator 106 can include a valve that controls the flow of air through the regulator 106. The air supply line 119 can supply compressed air to the fluid storage reservoir 111, which can be filled with any suitable liquid or flowable solid. The pressure regulator 106 can be configured to maintain air pressures within desired ranges to continuously drive fluid (e.g., the desired flavored liquid) from the fluid storage reservoir 111 and downstream from the drive system 110. For example, the pressurized air can be used to drive the fluid (e.g., the flavored liquid) from the fluid storage reservoir 111, along the fluid line 102 through the first valve 101*a*, and to the fluid dispensing system 1. In some embodiments, the fluid storage reservoir 111 may constitute a flexible plastic bag within a container, such as an IV bag, which may advantageously promote maintenance of a sanitary environment and reduced fluid storage reservoir costs. Furthermore, in some embodiments, a second sensor 133, such as a pressure sensor, may be provided to send feedback to the controller 103 to determine if the air passing through the line 119 is at the desired operating pressure for driving the fluid from the storage reservoir 111, and to monitor whether the regulator 106 is functioning properly.

Figure 2A:
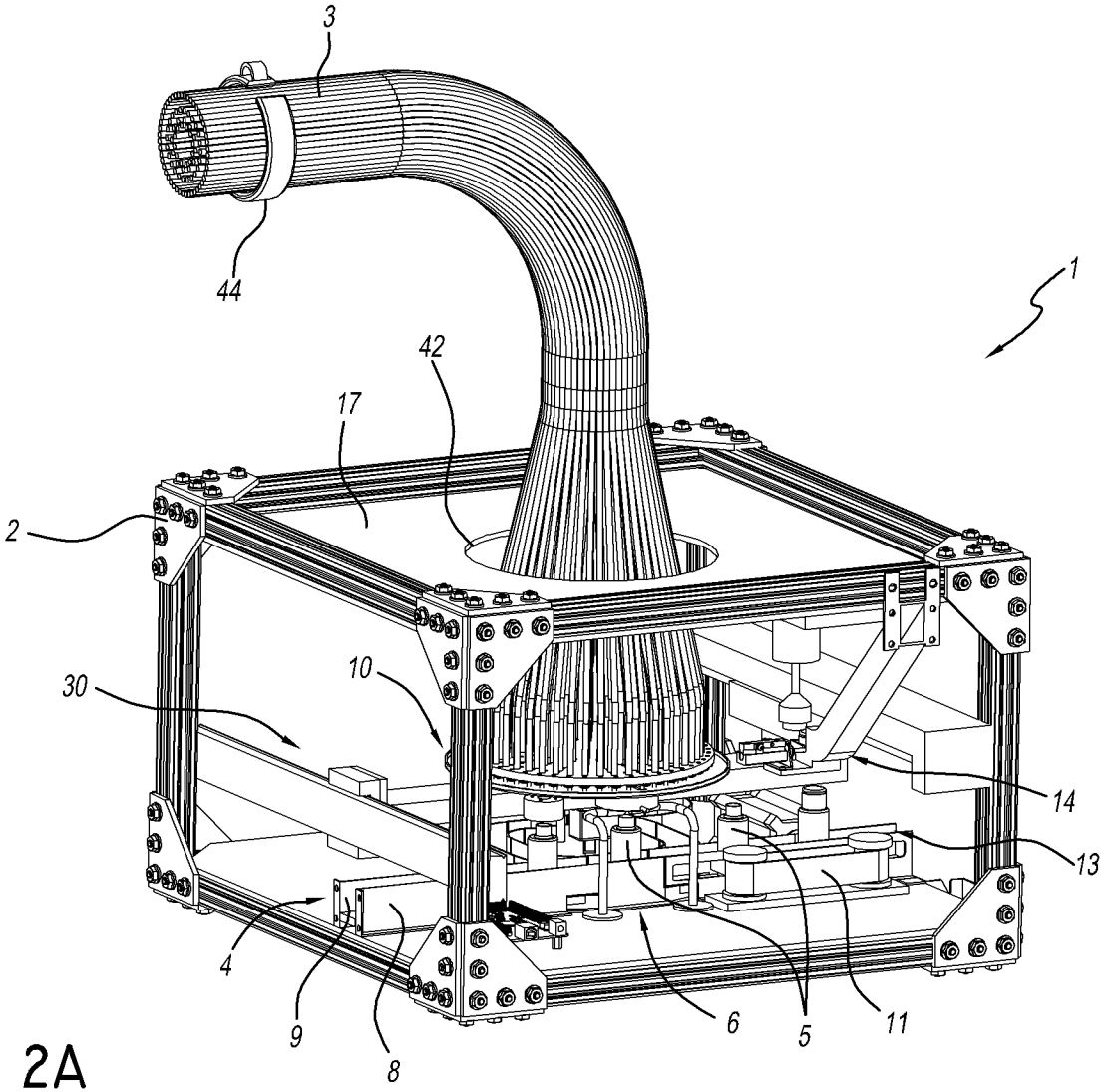
FIG. 2A is a three-dimensional, front, top, left side perspective view of a fluid dispensing system, according to some embodiments.
Figure 2B:
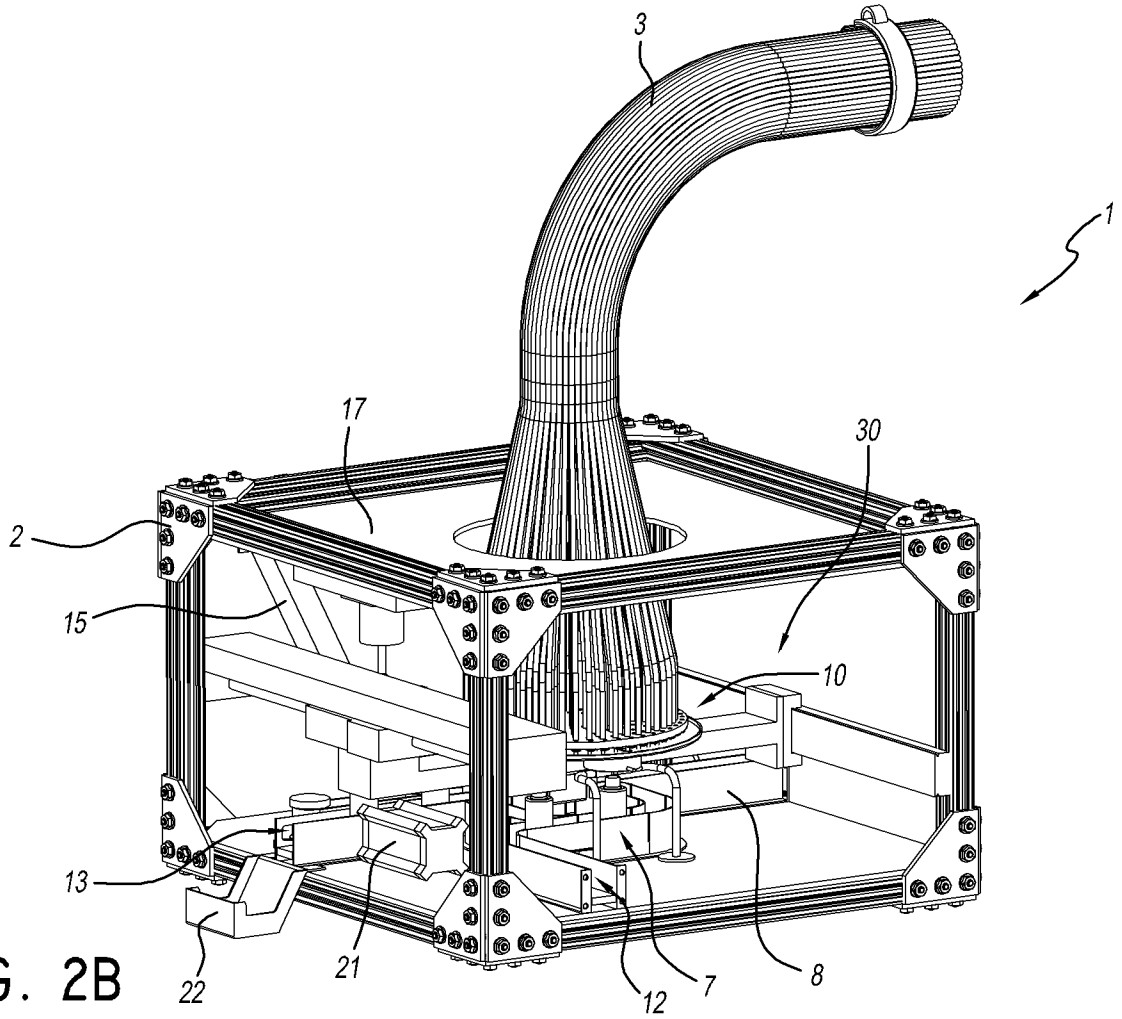
FIG. 2B is a three-dimensional, rear, top, right side perspective view of the fluid dispensing system of FIG. 2A.

FIG. 2A is a three-dimensional, front, top, left side perspective view of a fluid dispensing system 1, according to a preferred embodiment, and such as may be used in the fluid management system 100 of FIGS. 1A and 1*n* cooperation with the fluid drive system 110. FIG. 2B is a three-dimensional, rear, top, right side perspective view of the fluid dispensing system 1 of FIG. 2A. As discussed herein, the fluid dispensing system 1 can be housed within a housing, such as a kiosk or other type of housing. Accordingly, the system 1 disclosed herein can include a relatively small footprint, which can advantageously enable the positioning of the system 1 in any suitable location, e.g., within a store, etc. The fluid dispensing system 1 can be configured to dispense multiple different liquids into a suitable container 5 (e.g., one of a plurality of containers to be filled). For example, in some embodiments, the container 5 may comprise a bottle or cartridge adapted to be inserted into or couple to an e-cigarette device. The liquids that at least partially fill the container 5 may include, but are not limited to, base liquids including propylene glycol (PG) and vegetable glycerin (VG), in addition to flavored liquids, natural supplements, and/or nicotine. The system 100 may also be adapted for use in filling containers with lawful medicines.

The fluid dispensing system 1 may have a frame 2 configured to support the components of the system, and provide rigidity and/or protection to the components of the system. A bundle of tubes 3 (e.g., which may correspond to multiple fluid lines 102 shown in the schematics of FIGS. 1A and 1B) preferably disposed between the fluid drive system 110 and the frame 2, and may be supported by a bracket 44. The tubes bundle 3 may pass through an opening 42 in a top wall 17 of the frame 2 into an interior of the frame 2. The tubes 3 mechanically and fluidly couple to a turret assembly 10. For example, as discussed herein, distal ends of the tubes 3 may be screwed or otherwise fastened (e.g., by compression) proximate to corresponding apertures (described further herein) in the turret assembly 10 to provide fluidic communication with those apertures.

The turret assembly 10 preferably is configured to organize and manage the bundle 3 of tubes and protects the tubes from damage and tangling. An actuation assembly 30 preferably is provided to move the turret assembly 10. For example, the actuation assembly 30 can be configured to rotate the turret assembly 10 to align nozzles or outlets of the turret assembly with the mouth of the container 5. In some embodiments, the rotation of the turret assembly 10 can be limited to rotate a maximum of approximately plus or minus (+/−) 90 degrees from a home position at zero degrees, so that the plurality of tubes 3 (whose portions seen in FIG. 2A are flexible, such as elastomeric Tygon® tubing) are not subjected to undue stress, kinking and damage; those portions of those tubes seen in FIG. 2A are attached to the turret assembly 10 and move with the assembly 10, while the portions of the tubes 3 near the bracket 44 normally may be relatively stationary. Thus, rotary movement of the turret assembly is regulated to avoid undue tension or crimping in the tubes 3. Moreover, a predetermined limitation on the range of angular rotation reduces loading on the turret rotation motor as well.

The fluid dispensing system 1 includes one or more dispensing stations adapted to receive a container 5 that is to be at least partially filled with fluid. For example, the system 1 may include at least a first dispensing station 6 (as labeled in FIG. 2A) and optionally a second dispensing station 7 (FIG. 2B). Containers 5 can be positioned at the respective dispensing stations 6, 7 below outlets of the turret assembly 10. The outlets of the turret assembly 10 can be any suitable fluid outflow aperture that is configured to allow fluid to pass from the tubes 3 to the container 5. For example, in some embodiments, the outlets may comprise nozzles extending outwardly from a face of the turret assembly 10 and configured, when in use, to selectively dispense liquid from the tubes 3 to the container 5. In some arrangements, the nozzles may comprise a valve, such as a check valve. When any one of the outlets is substantially vertically aligned with the opening in a container 5, fluid can pass through the outlet of the turret assembly 10 and into the container 5 to at least partially fill the container 5. Although two dispensing stations 6, 7 are illustrated in FIGS. 2A and 2B, other numbers of dispensing stations can be provided, including one, three, four, or more dispensing stations.

Providing multiple dispensing stations 6, 7 allows for higher throughput, and/or can allow for containers 5 to be filled by nozzles of the turret assembly 10 that are closer to a particular dispensing station 6, 7. For example, if the fluids to be dispensed will pass through particular tubes 3 that are closer to the first dispensing station 6, then the container 5 may be routed to the first dispensing station 6. The provision of two (or potentially more than two) dispensing stations allows duplicative dispensing of popular high-volume recipes that may require redundancy of a fluid flavor, i.e., on a different side of the overall system (e.g. kiosk). Also, a second source of containers (e.g. bottles, cartridges) for the second station 7 could supply containers if the first dispensing station 6 happens to run out of supplied containers. In some embodiments, the first and second dispensing stations 6, 7 may be configured to fill two respective containers 5 simultaneously, which can increase throughput. For example, if two containers 5 are to be filled with a similar recipe, and if the tubes 3 are appropriately coupled to the turret assembly 10, then the two containers can be filled with fluid substantially at the same time. As one example, two of the tubes 3 adapted to carry the same liquid may be coupled to the turret assembly 10 at diametrically opposing locations on the turret assembly 10, so that when the turret assembly 10 is rotated appropriately, one tube is aligned with the first dispensing station 6 and the other tube is aligned with the second dispensing station 7. In such embodiments, the positions of the tubes for a particular liquid may be selected such that the outlets for the same liquid automatically align with each respective station 6, 7 simultaneously upon regulated rotation of the turret assembly 10. Thus, by rotating the turret assembly 10, the same fluid may be provided to outlets on opposing sides of the turret assembly 10.

In some alternative embodiments, however, the two dispensing stations 6, 7 may fill multiple containers 5 sequentially. For example, a container 5 may be at least partially filled with a first fluid at the first dispensing station 6, and the container 5 may then be moved to the second dispensing station 7 to be at least partially filled with a second fluid, or vice versa. In some embodiments, different types of containers (such as bottles of different colors, styles, types, etc.) can be run through the system 1 simultaneously or sequentially so that different liquid mixtures for different bottle colors can be processed by the system 1. For example, two (or more) brands of e-cigarette liquid can be used in the system 1.

Figure 2C:
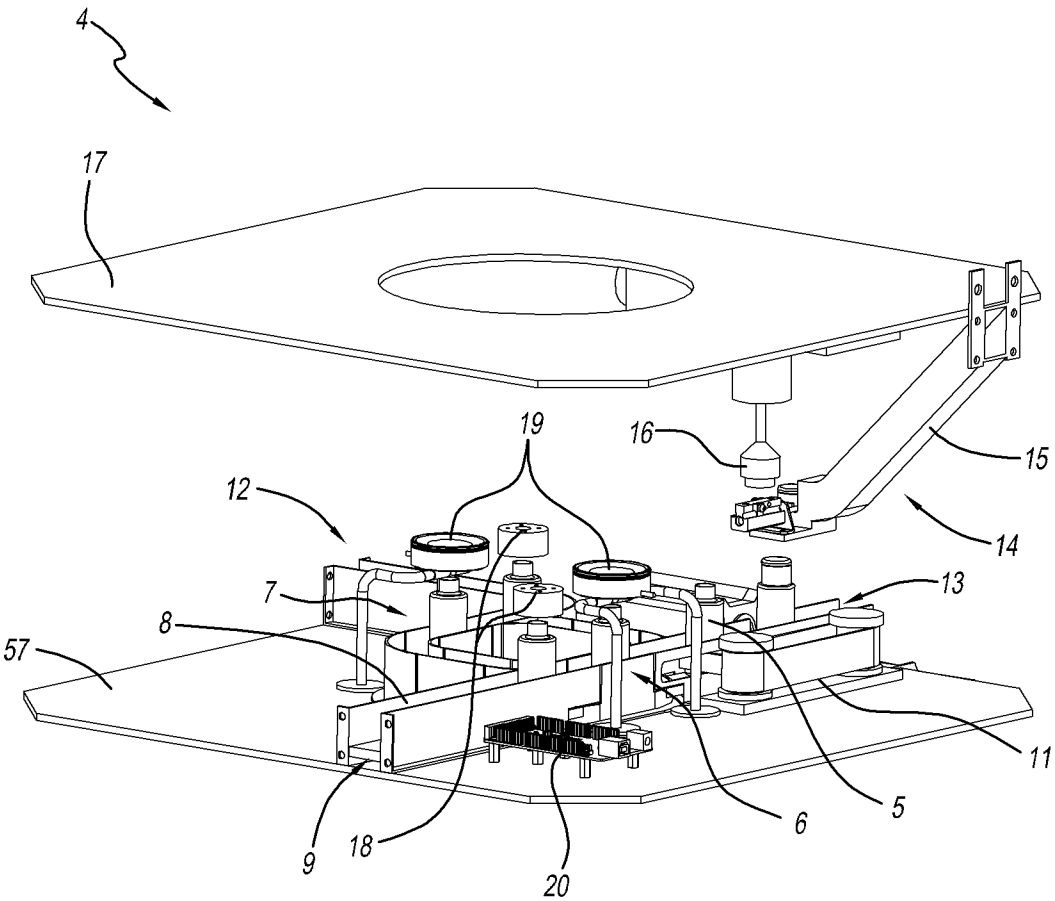
FIG. 2C is a three-dimensional, front, top, left side perspective view, in isolation, of a conveyance system usable in the fluid dispensing system of FIG. 2A.
Figure 2D:
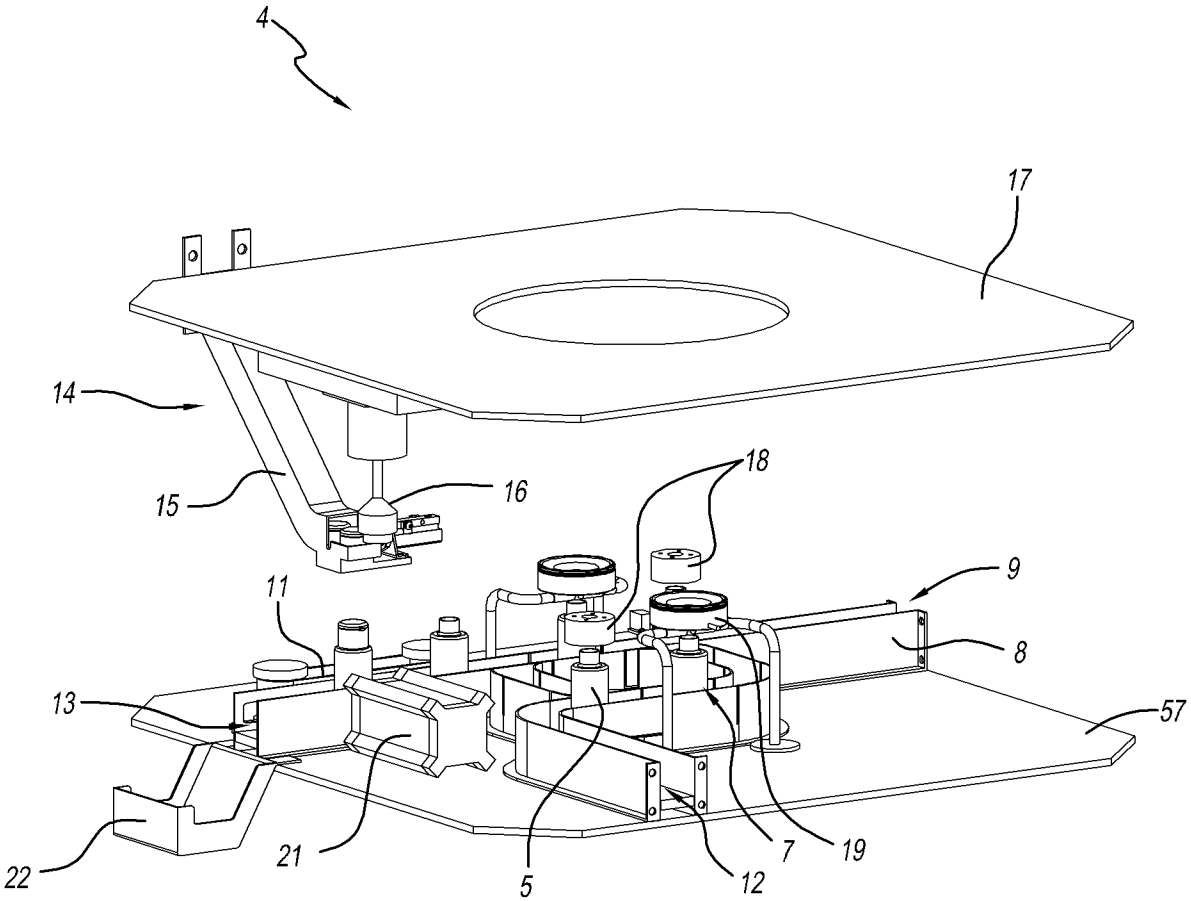
FIG. 2D is a three-dimensional, rear, top, right side perspective view of the conveyance system illustrated in FIG. 2C.
Figure 2E:
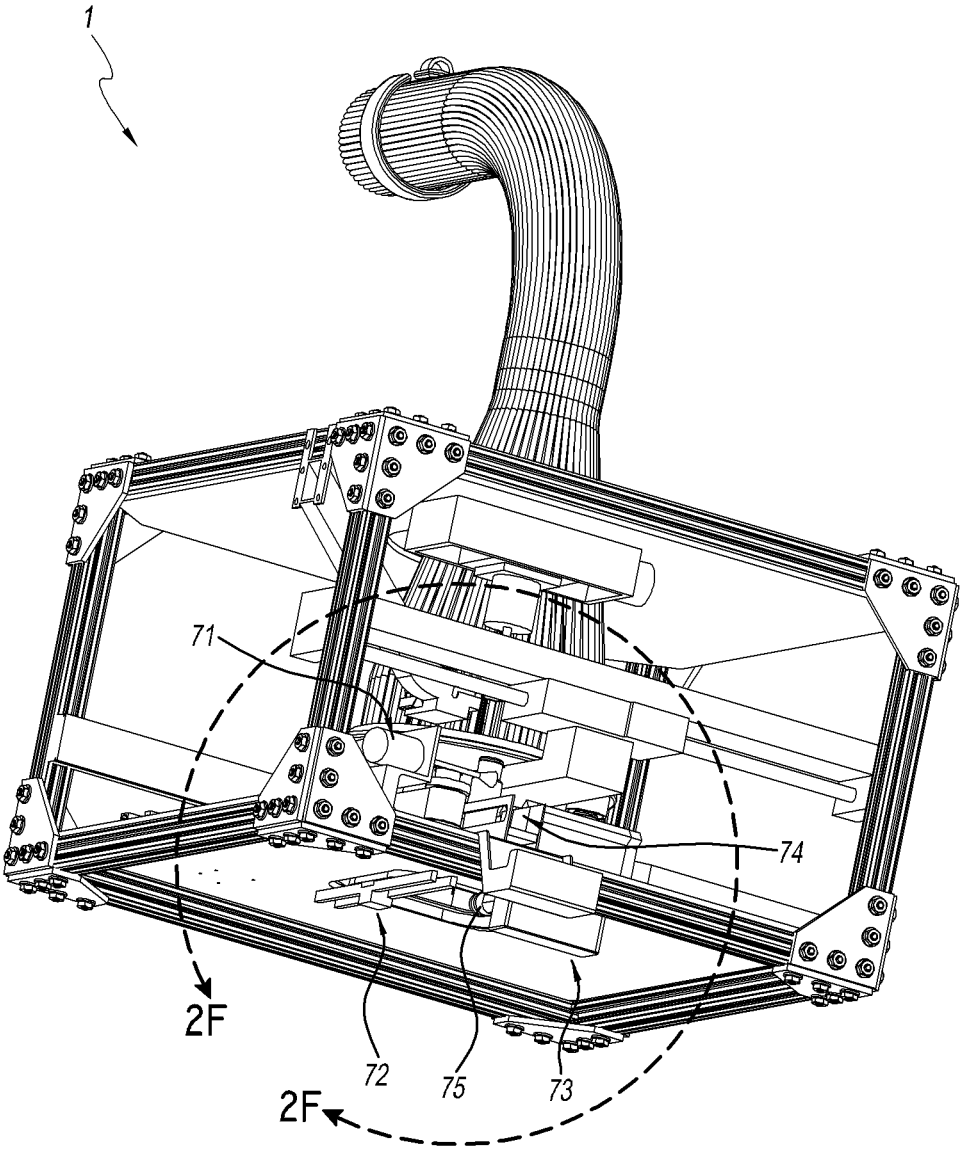
FIG. 2E is a three-dimensional, rear, bottom, right side perspective view of a fluid dispensing system, according to some embodiments.
Figure 2F:
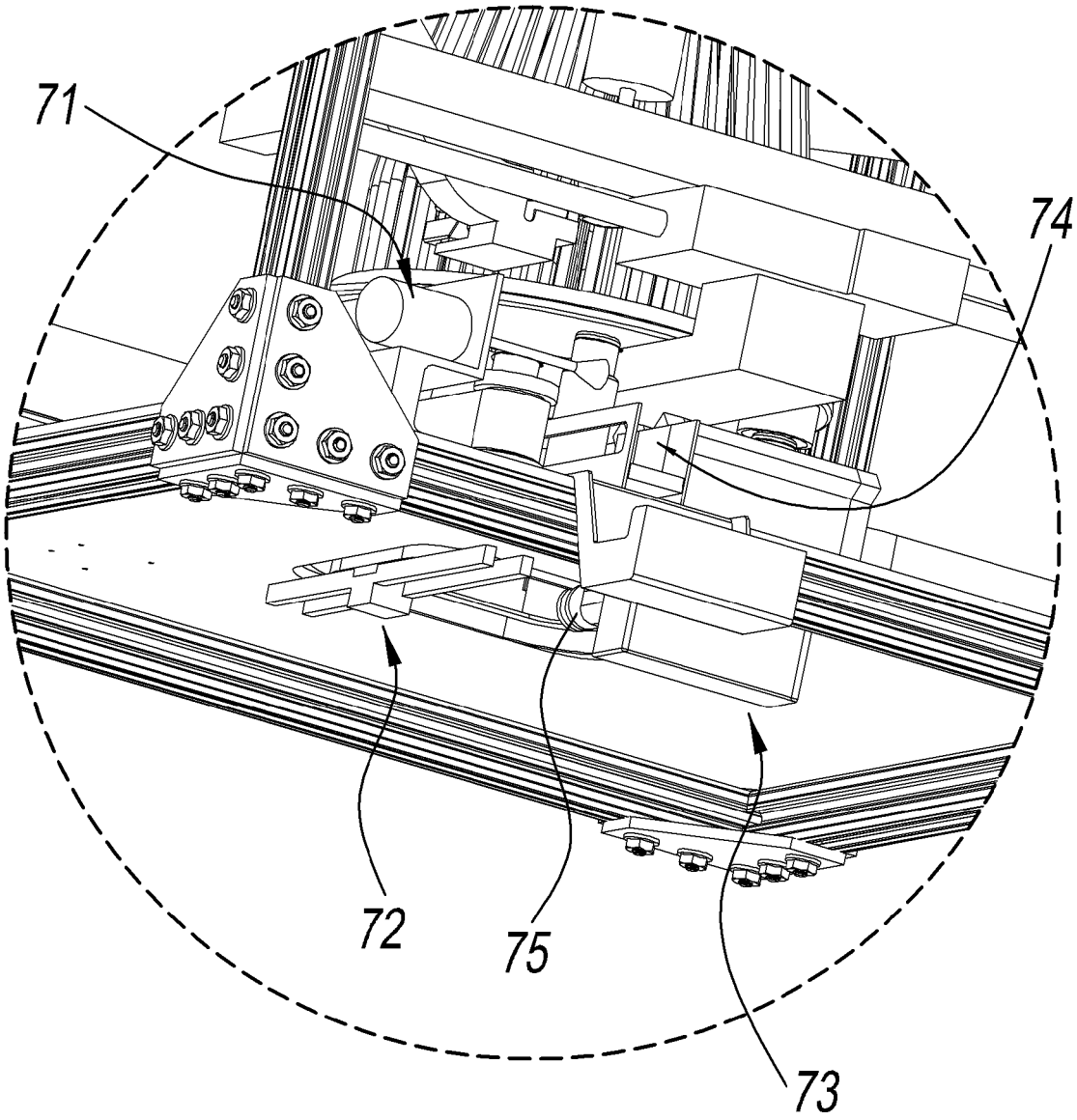
FIG. 2F is a magnified view of a portion of the system illustrated, and identified at "2F," in FIG. 2E.

The fluid dispensing system 1 preferably but optionally includes a conveyance sub system 4 configured to move containers 5 to and through the dispensing stations 6, 7. FIG. 2C shows a three-dimensional, front, top, left side perspective view of a possible conveyance system 4 usable in the fluid dispensing system 1, seen from the same perspective as FIG. 2A. FIG. 2D is a three-dimensional, rear, top, right side perspective view of the conveyance system 4 as seen from the perspective of FIG. 2B. FIG. 2E is a three-dimensional, rear, bottom, left side perspective view of the fluid dispensing system 1, according to some embodiments. FIG. 2F is an enlarged view of the system 1 illustrated in FIG. 2E.

With combined reference made to FIGS. 2C-2F, the conveyance system 4 is seen preferably to include a base 57 upon which various components of the conveyance system 4 are disposed and/or coupled. The conveyance system 4 may include a raceway 8 defining a pathway along which containers 5 move. Walls of the raceway 8 maintain each container 5 within the pathway, and help to steer the containers 5 along the pathway. A conveyor belt drive apparatus 75 (FIG. 2E) may be configured to continually move a conveyor belt along the raceway 8 to move the containers 5 through the system 1. As explained below, a positioning device 11 may be provided to drive the containers 5 through various portions of the system 1, such as various dispensing and final processing stations. The conveyance system 4 may include a first entrance 9 and a second entrance 12. Containers 5 passing along the raceway 8 and through the first entrance 9 may be routed through the first dispensing station 6. Similarly, containers 5 passing along the raceway 8 through the second entrance 12 may be routed through the second dispensing station 7. In some embodiments, the raceway 8 may be configured to provide a pathway between the first and second dispensing stations 6, 7, such that the containers 5 can be moved from the second dispensing station 7 to the first dispensing station 6, and vice versa. For example, as discussed above, in some embodiments, fluid may be dispensed into a given container 5 sequentially, first at dispensing stations 6, then at dispensing station 7. Entrances 9, 12, interface with containers (e.g., bottle cartridges that engage at those locations. These would snap into place. A conveyance subsystem internal to the system nevertheless is needed due to the relatively high placement accuracy required to precisely locate the container at the dispensing stations 6, 7.

As seen in FIG. 2C, the fluid dispensing system 1 preferably includes a controller 20 adapted to control the operation of the system 1. As discussed herein, the controller 20 includes any suitable processor and/or memory device for storing non-transitory instructions. The controller 20 can be configured and programmed to control the operation of the turret assembly 10, the actuation assembly 30, and/or the conveyance system 4. The controller 20 may be similar to, or the same as, the controller 103 of FIG. 1A, and can control the fluid management system 100. Alternatively, the controller 20 may be one of plurality of controllers making up the aggregate controller 103 (as mentioned herein above) and can be configured to control only components in the fluid dispensing system 1.

The fluid dispensing system 1 may offer advantages of sanitation. It may be preferable, for example, to ensure that components of the system are clean to safeguard that users' health is not affected by bacteria, viruses, etc. Accordingly, one or more sanitation stations 18, 19 may be provided in the system 1. These container sanitation stations 18 may be provided to sanitize the containers 5 before and/or after filling with the fluid. One or more turret sanitation stations 19 may be provided to sanitize outlets or nozzles of the turret assembly 10. The turret sanitation stations 19 clean the outlets or nozzles between fillings to ensure that the outlets or nozzles are sanitized. Any suitable type of sanitation protocol may be used may be used at these sanitation stations 18, 19. For example, in some embodiments, radiation, e.g., ultraviolet (UV) light, is directed onto the components to be cleaned to sanitize the components. In some embodiments, a UV ring light at the container sanitation station 18 may be pointed downwards into and onto the bottle, and a UV ring light at the turret sanitation station 19 may be pointed upwards towards the turret assembly 10. In various embodiments for turrets and drip trays, a sanitizing liquid may be applied to the outlets or nozzles of the turret assembly 10 and/or the containers 5. The sanitation stations thus 18, 19 ensure that users of the system are supplied with sanitary containers 5 and fluids.

The fluid dispensing system 1 optionally may further include a container capping subsystem 14 configured to apply a cap to the container 5 after the container is at least partially filled with the fluid. Reference is invited to FIGS. 2C and 2D. The positioning device 11 can be used to move the container 5 through the capping system 14 in some embodiments. The container capping system 14 can include a cap dropper chute 15 adapted to feed caps to the conveyance system 4. For example, the housing can include a storage device that includes multiple caps. The caps can be loaded into the cap dropper chute 15 and can slide downwardly into the system 1 by gravity or motor control. The container capping system 14 can also include a container cap installer 16 configured to apply the cap to the container 5. For example, in some embodiments, the cap installer 16 may include a motor-driven linear slide and a vertically mounted motor positioned over the cap, fed to the installer 16 by the cap dropper chute 15. The vertically-mounted motor of the cap installer 16 couples a socket cap attachment over the cap, and lifts the cap vertically from a distal portion of the cap dropper chute 15. The cap installer 16 lowers the cap onto the top of the container 5 and, for threaded container (e.g.) bottle tops, the installer 16 rotates to thread the cap onto the container 5. Although the container capping system 14 of FIGS. 2A-2D is configured to apply a cap to a container 5 such as a bottle, it should be appreciated that other ways of closing and/or sealing the at least partially filled containers 5 are possible. In alternative embodiments, a heat sealing seam system may be used to seat the containers 5. For example, if plastic squeeze bottles are used as the containers 5, the tops of the squeeze bottles (or bottoms if the top is the "cap") can be heat sealed after at least partially filling the containers 5.

FIG. 2D illustrates that the system 1 also may include a labeling subsystem 21 configured to print or otherwise affix a label to the container 5. In other embodiments, the labeling system 21 can be configured to apply a label to the container 5. The positioning device 11 can be used in some arrangements to move the containers 5 through the labeling system 21. For example, in some embodiments, the entity hosting or owner of the kiosk or housing that includes the system 1, or the manufacturer of the system 1 or fluids, may desire to create their own labels for the containers 5. In some other embodiments, the user who selects and/or creates the fluid mixture may desire to create his or her own labels to be applied to the container 5 by the labeling system 21. For example, the user can engage the user interface 115 to create his own label, including, e.g., a name for the recipe, a picture or image, a list of the ingredients, etc. The labeling system 21 may comprise any suitable labeling device. For example, the labeling system 21 can comprise a laser marking device, an ink jet print head, a paper-and-adhesive labeling device, or any other suitable labeling device. Labels (e.g., front and back) alternatively may be pre-installed upon the containers, with a scannable bar code already on the labels according to known art. The bar code can be read by a bar code reader prior to an ink jet printer, and be assigned to the fluid formula being created.

The fluid dispensing system 1 optionally includes one or more sensors configured to measure the weight of fluid in the container 5. For example, a scale can be used to measure the weight of the fluid, and/or a drop counter or other suitable sensor can be used to measure the weight of the fluid and/or the volume of the fluid in the container 5 at stations 6 or 7. Once the fluids are accurately dispensed into the container 5 and the container 5 is ready to be provided to the user, the conveyance system 4 moves the container 5 to the system exit portal 13. A dispensing bin 22 preferably is configured to hold the filled container 5 after exiting the system 1. The dispensing bin 22 may extend outward from the housing, or may include a door through which the user can retrieve the filled container 5. This dispensing bin 22 can also be longer than what is shown and can contain various jogs and steps which can be used to provide final mixing of the contents prior to retrieval by the end user. A scale or other sensor can also be provided to verify that the container 5 has been delivered to the dispensing bin 22 and/or retrieved from the bin 22 by the user.

Turning now to FIG. 2E, a conveyor belt drive apparatus 75 is illustrated as a part of the system. The conveyor belt apparatus 75 may be mounted on a back side of the base 57, and can be controlled and operated by means of the controller 20. The conveyor belt apparatus 75 moves containers 5 through the fluid dispensing system 1. Furthermore, as discussed above, it may be advantageous in some embodiments to include a scale or other device adapted to accurately measure the amount of fluid in each container 5. Accordingly, as shown in FIG. 2E, a scale 72 can be provided near and/or underneath a particular dispensing station. The conveyor belt apparatus 75 moves the containers 5 in position on or near the scale 72. The scale 72 may be any suitable type of scale, such as a digital measurement scale or load cell configured to measure the weight and/or mass of a container. The scale 72 can be configured to measure the amount of each ingredient that is added to each container 5 to ensure that the final mixture of liquids is within pre-determined quality control measures. In some embodiments, the scale 72 preferably measures the weight of the container 5 at sensitivities capable of estimating the volume of liquid in the container 5 to within plus or minus about 0.05 mL, e.g., to within about one drop of liquid. In some embodiments, the fluid can be dispensed more accurately, e.g., on the scale and accuracy of inkjet printers. Feedback loops can also be provided between the scale 72 and the controller 20 to controllably actuate the opening of the nozzles and valves in the turret assembly in order to meter the desired quantity of fluid from the nozzles into a container 5.

The fluid dispensing system 1 illustrated in FIG. 2E may also include a bottle rejection apparatus subsystem by which containers 5 that are determined to not meet quality criteria are rejected and prevented from being dispensed to the user. The positioning device 11 can move the containers 5 to the bottle rejection apparatus. For example, if the container 5 is filled with an amount of liquid that differs from the amount desired by the user, then the system 1 can reject that container 5 and re-fill another container with the appropriate amount of liquid. Furthermore, if the incorrect type of liquid is introduced into the container 5 (e.g., if the turret assembly 10 is determined to be misaligned), then the system 1 can also reject that container 5. Accordingly, the bottle rejection apparatus can communicate with the controller 20 and other components of the system 1 (such as the scale 72). The system 1 may include a bottle ejector actuator 71 configured to eject and/or push the rejected container through a trap door 74 provided through a raceway 8 of the conveyance system 4. For example, the bottle ejector actuator 71 may comprise a motorized arm or pneumatic actuated piston actuator or venturi air nozzle that, when actuated, ejects a rejected container through the trap door 74, which may be spring- or air-loaded in various arrangements. The rejected container can pass through the trap door 74 and into a bottle rejection bin 73. The bottle rejection bin 73 collects the rejected containers 5, which can be returned to the container and/or liquid supplier, or be properly disposed of. The supplier can analyze the contents of any rejected bottle to improve the dispensing of liquids by, e.g., verifying the type and amount of liquid dispensed. A scale or other sensor may be disposed on or near the rejection bin 73 to verify proper rejection of the container 5.

Figure 3A:
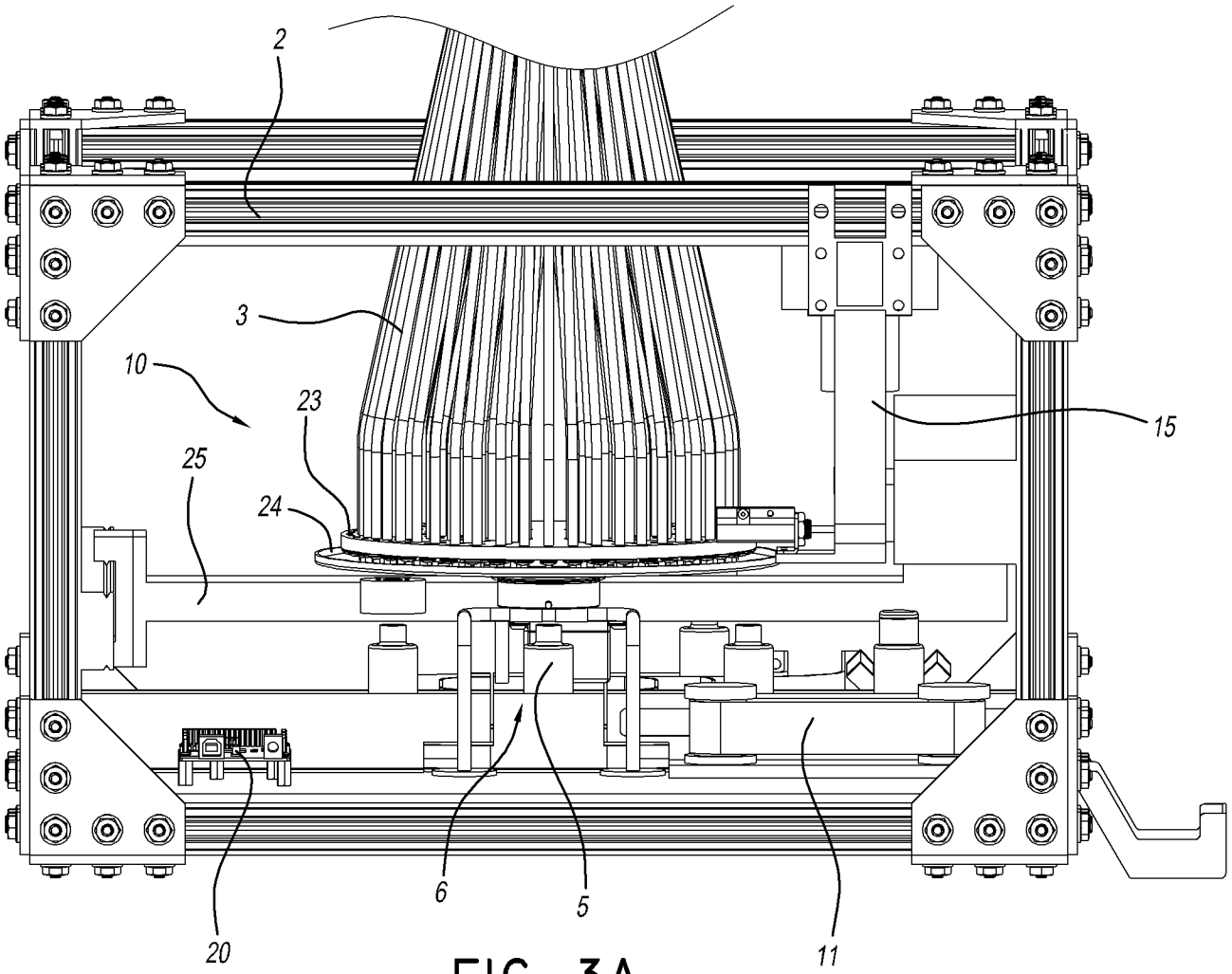
FIG. 3A is an enlarged, front view of a turret assembly and a first dispensing station of the fluid dispensing system of FIG. 2A.

FIG. 3A is an enlarged, left side view of the turret assembly 10 and the first dispensing station 6 of the fluid dispensing system 1. As discussed herein, the container 5 can be transported by way of the conveyor belt apparatus 75 (FIG. 2E) to the first dispensing station 6 to receive a dispensed fluid mixture according to a desired recipe. The turret assembly 10 includes a turret 23 and a drip tray 24 disposed adjacent to and spaced apart from the turret 23. The bundle of tubes 3 may be mechanically coupled to a top side of the turret 23, e.g., by way of fasteners, such as screws, or may be elastically coupled to receiving nubs on the turret or barbs on the nozzles. In some embodiments, screws may be applied on the top side of the turret or on an opposite, bottom side of the turret 23 to couple the tubes 3 to the turret 23 by way of removable nozzles.

As mentioned previously, each tube 3 in the bundle may be in fluid communication with a particular fluid, which may be different from the fluids carried by several of the other bundled tubes 3. It is appreciated that in some arrangements, multiple tubes 3 may also transport the fluid of the same type, such as in cases where a particular fluid is found to be particularly popular. Redundancy can be provided to meet the demands imposed by popular ingredients. Accordingly, more than one reservoir in the system may contain a particularly high-demand fluid, and this plurality of reservoirs is in fluid communication with a corresponding plurality of fluid outlets on the turret assembly. Also, in some embodiments, the controller 20 may be configured to determine the relative quantities of fluids available. Additional quantities of fluids that are "low" may be connected to unconnected outlets or to different outlets (e.g., nozzle outlets) from the outlets that previously supplied those fluids, thereby allowing the system to be "refilled" without taking the system offline. To dispense a selected fluid into the container 5, the tube 3 associated with, and in fluid communication with, the selected reservoir of the selected fluid can be aligned with the first dispensing station 6 or the second dispensing station 7 and container 5 by way of the turret 23 which is movable into position.

Figure 3B:
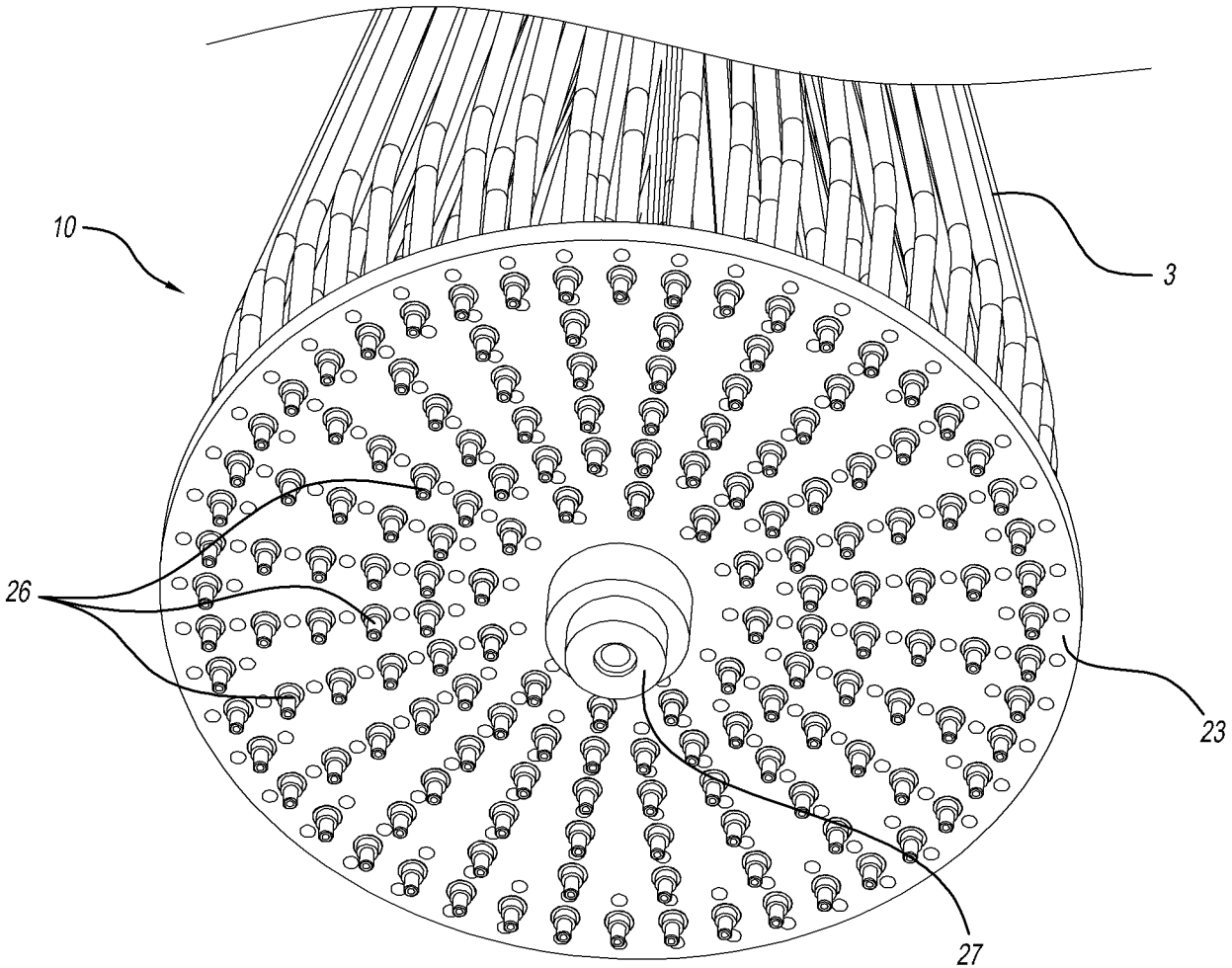
FIG. 3B is a three-dimensional, bottom perspective view of a turret having a plurality of nozzles coupled thereto.
Figure 3C:
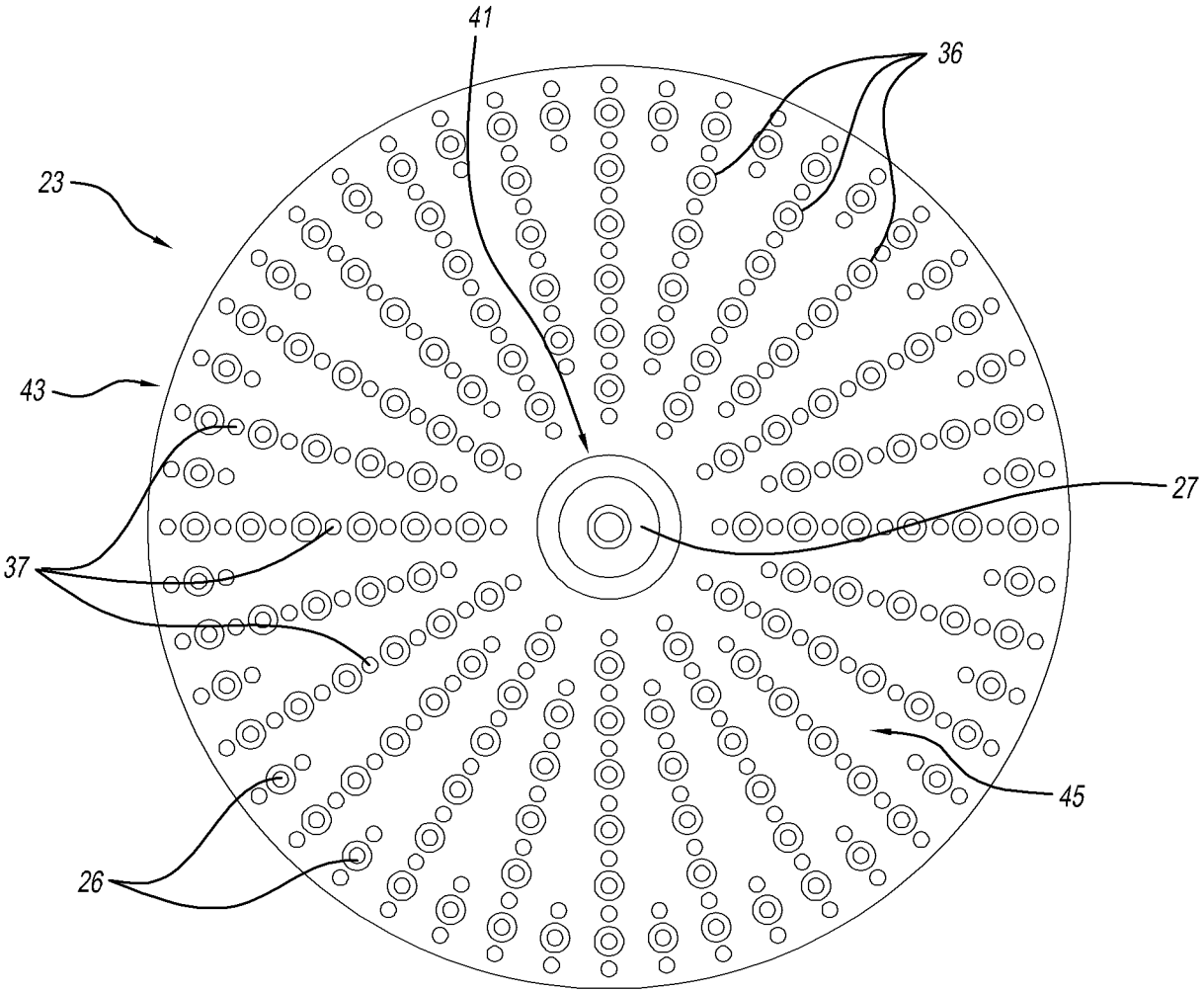
FIG. 3C is a bottom plan view of the turret of FIG. 3B.

Reference is made to FIG. 3B, providing a three-dimensional, bottom perspective view of the turret 23. There is illustrated the turret's having a plurality of nozzles 26 coupled thereto. FIG. 3C is a bottom plan view of the turret 23 of FIG. 3B. The turret 23 shown in FIGS. 3A-3B is disc-shaped, e.g., substantially round, although any suitable shape may be used. The nozzles 26 may act as outlets such that the fluid passes from the tubes 3 through the nozzle 26 and into the container 5 located at the first dispensing station 6 (e.g., FIG. 3A) and/or the second dispensing station 7. When a selected fluid is desired to be dispensed into the container 5, the controller 20 actuates the first valve 101*a* of the tube 3 associated with the selected fluid, and the selected fluid can be driven through the corresponding tube 3 and to the nozzle 26 coupled with that tube 3. As discussed above with respect to FIG. 1A, the nozzles 26 may act as the second valve 101*b* to selectively permit fluid to flow therethrough. For example, each nozzle 26 or outlet can comprise a check valve. In such embodiments, when fluid is driven through a particular tube 3, a pressure differential is generated across the check valve. When the pressure differential is sufficiently high, e.g., when sufficient fluid is driven to the appropriately particular nozzle 26, the check valve's pressure threshold, also known as "cracking pressure," may be overcome, and the fluid may be allowed to flow through the nozzle 26 and into the container 5.

As shown in FIG. 3C, the turret 23 preferably has a plurality of apertures 36, and the nozzles 26 of FIG. 3B may couple to corresponding apertures 36. For example, in some embodiments, the nozzles 26 pass through corresponding apertures 36 such that an inlet end of the nozzle 26 or outlet is in fluid communication with the tube 3 and that an opposite outlet end of the nozzle 26 faces towards (e.g., downward) the container 5 and dispensing station 6 or second dispensing station 7. In alternative embodiments, the nozzles 26 may be coupled to a top side of the turret 23 over corresponding apertures 36. In some embodiments, fastener holes 37 may also be provided through the turret 23. The fastener holes 37 can be sized to receive screws or other fasteners that are used to mechanically couple the tubes 3 to the turret 23 by way of interfacing nozzles 26.

The apertures 36 and nozzles 26 can advantageously be disposed in a pre-determined pattern across the turret 23. The turret 23 can include a central region 41 near the center of the turret 23. As shown in FIGS. 3B and 3C, a hub 27 can extend from the turret 23. As discussed herein, the hub 27 can be used to couple the turret 23 to a motor. For example, in some embodiments, the hub 27 can be configured such that the turret 23 couples to the motor in a predetermined way. The turret 23 can also include a peripheral region 43 located near or along a boundary of the turret 23, e.g., a region along the circumference of the disc-shaped turret 23 of FIG. 3C. As shown in FIG. 3C, the nozzle apertures 36 and the nozzles 26 themselves can be disposed in a two-dimensional array 45. The two-dimensional array 45 may be disposed between the central region 41 and the peripheral region 43. Using a two-dimensional array 45 of nozzles 26 and nozzle apertures 36 advantageously increases the number of nozzles 26 used in the turret 23. As a result, the number of tubes 3 and different fluids that can be dispensed can also be increased. The increased number of fluids used in the system 1 enables a user to create complex recipes having unique flavor profiles. In addition, the large number of outlets or nozzles 26 allows different total quantities of fluids to be available to the turret 23, which can have advantages for extending the time between fluid refilling. Moreover, the large number of individual outlets or nozzles 26, relative to prior art devices, are efficiently and readily brought into proper alignment position with a given container 5, by means of the turret assembly 10 that is capable of both rotary and linear movement. Controlled rotation of the turret assembly permits nozzles 26 along or adjacent a particular radius of the turret 23 to be brought into a radial linear registration with the location of a dispensing station 6 or 7. Then, a given nozzle among those along or adjacent the selected radius can be brought into accurate alignment with a container by linearly shifting the turret assembly 10 by means of the actuation assembly. For example, different fluids can be connected to different numbers of outlets, with the numbers of outlets for a particular fluid being determined based upon the popularity of the different fluids in a particular period of time and/or in a particular location.

As shown in FIG. 3C, the two dimensional array 45 can be patterned to resemble a spoke pattern, e.g., nozzles 26 and apertures 36 that extend radially from the central region 41 towards the peripheral region 43. The array 45 may include multiple circumferentially-spaced sets of nozzles 26 (and apertures 36). Each set of nozzles 26 can include multiple, radially-spaced nozzles 26 extending from the central region 41 towards the peripheral region 43. Such an array 45 can advantageously increase the number of fluids provided by the system, while also enabling efficient and accurate dispensing of the fluids, as discussed below with respect to the actuation assembly 30.

Figure 3D:
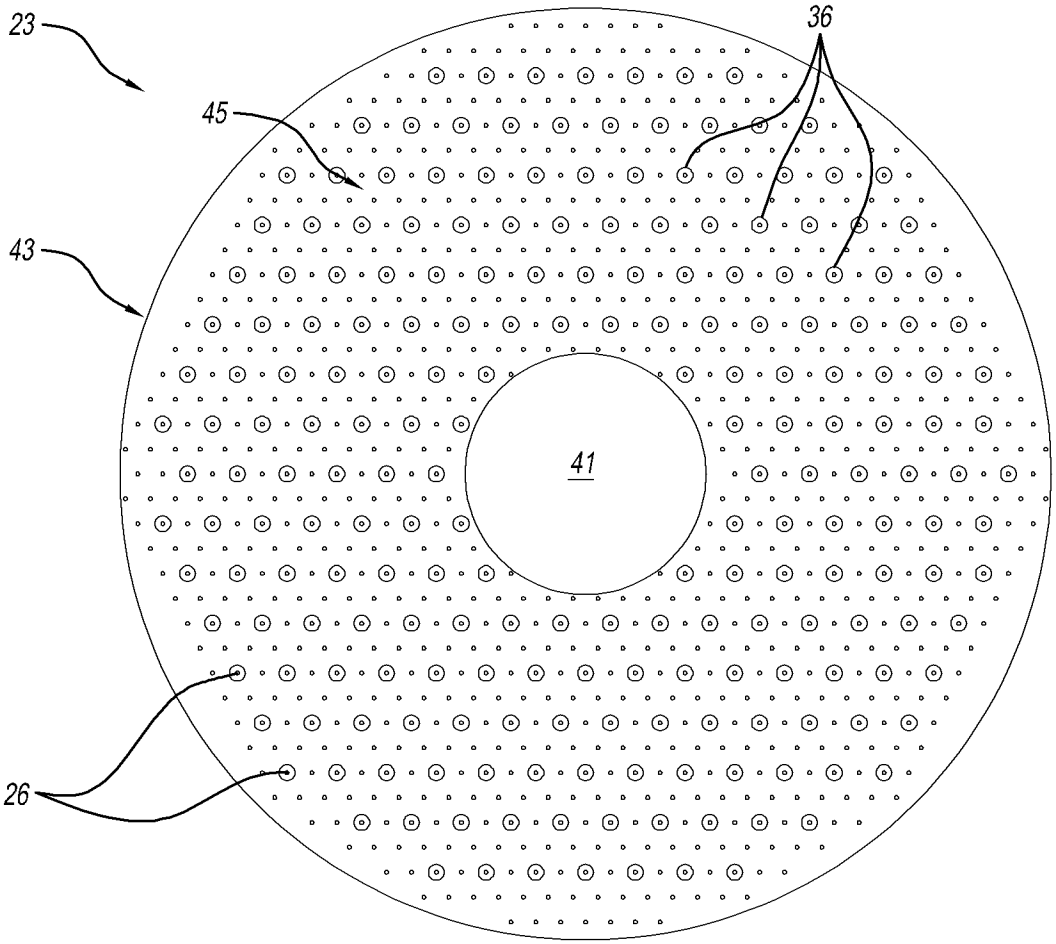
FIG. 3D is a bottom plan view of a turret, according to some other embodiments.

FIG. 3D is a bottom plan view of a turret 23, according to some other embodiments. The reference numerals of FIG. 3D generally refer to components that are the same as or similar to similarly numbered components of FIG. 3C, except as noted. For example, the turret 23 can be a disc-shaped plate or member that includes or defines a plurality of nozzle apertures 36 disposed in a pattern across a face of the turret 23. The turret 23 may include a central region 41 and a peripheral region 43. As with FIG. 3C, the turret 23 can include a two-dimensional array 45 of nozzle apertures 36 and nozzles 26 disposed between the central region 41 and the peripheral region 43. However, unlike the two-dimensional array 45 shown in FIG. 3C, the two-dimensional array 45 of FIG. 3D can be formed in a hexagonal packing pattern. For example, the array 45 of nozzles 26 and nozzle apertures 36 of FIG. 3D can be disposed such that each or a majority of the nozzles 26 and apertures 36 is disposed adjacent to and between six other nozzles 26 and apertures 36. As with the embodiments of FIG. 3C, the embodiments of FIG. 3D can also advantageously increase the number of nozzles 26, and therefore fluids, that can be dispensed through the turret 23.

Figure 3E:
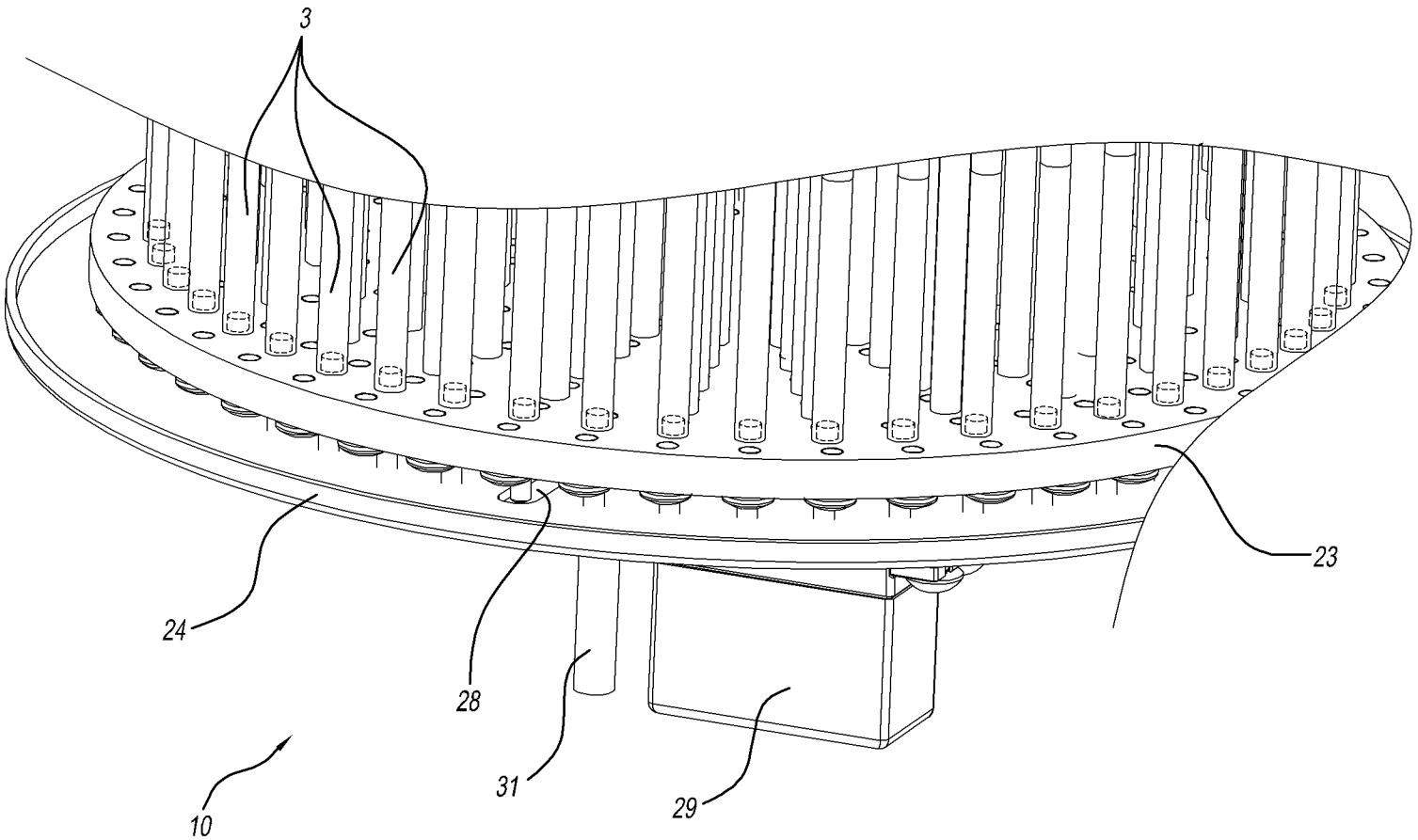
FIG. 3E is an enlarged, schematic three-dimensional top perspective view of the turret assembly of FIG. 3A that includes the turret and a drip tray.
Figure 3F:
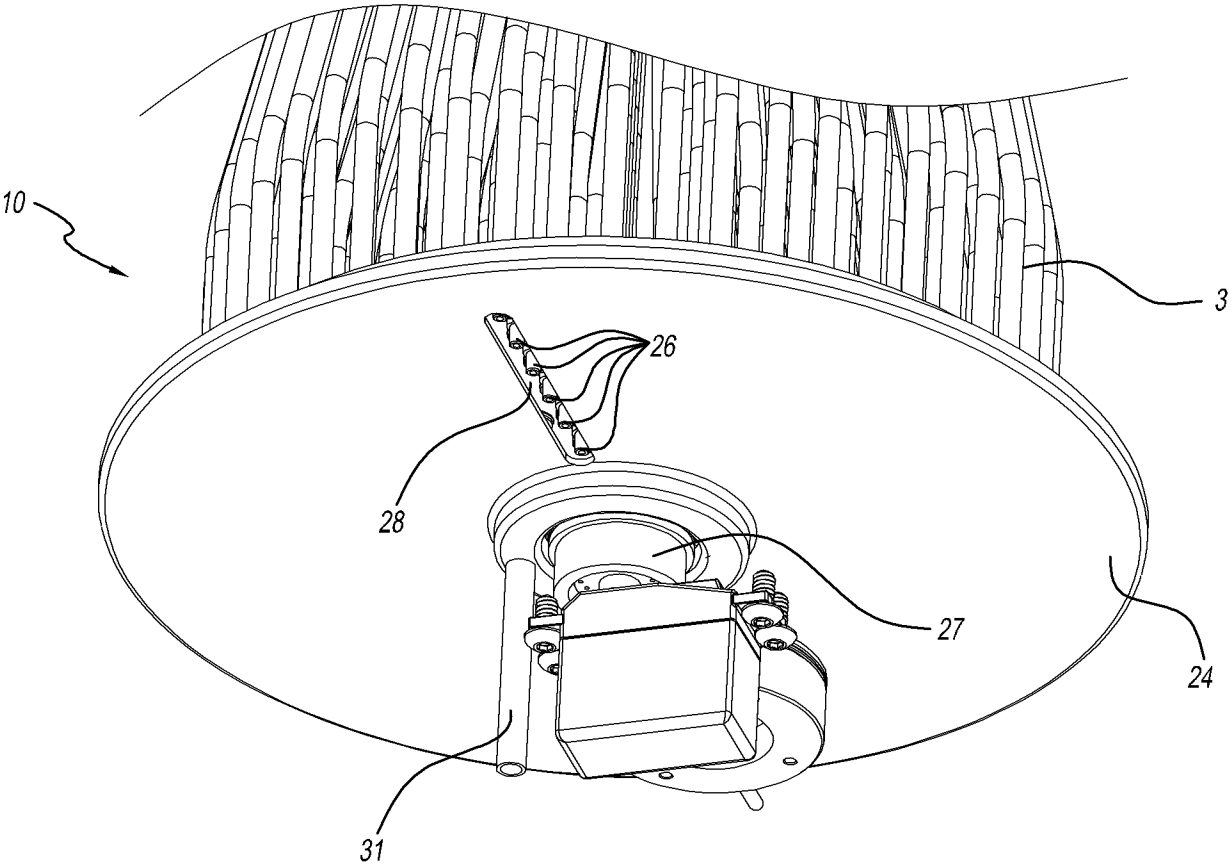
FIG. 3F is an enlarged, schematic three-dimensional bottom perspective view of the drip tray of FIG. 3E.

FIG. 3E is an enlarged, schematic three-dimensional top perspective view of the turret assembly 10 of FIG. 3A that includes the drip tray 24 spaced apart and disposed downstream from the turret 23. FIG. 3F is an enlarged, schematic three-dimensional bottom perspective view of the drip tray 24 of FIG. 3E. In some situations, some nozzles 26 may leak fluid when not actuated or open. The drip tray 24 can be shaped to collect fluid that undesirably drips from nozzles 26 and transport the collected fluid to a waste container, which may be the waste reservoir 113 of FIG. 1A. A drain tube 31 may be in fluid communication with a collecting surface of the drip tray 24, and the drip tray 24 can be shaped such that fluid flows along the tray 24 and into the drain tube 31. The drain tube 31 can be in fluid communication with the waste reservoir 113 by way of one or more conduits (not shown). Thus, the drip tray 24 and drain tube 31 may advantageously collect undesirable waste fluids and transport them to the waste reservoir 113 for disposal. As shown in FIG. 3F, a slot 28 can be formed through the drip tray 24 to permit the nozzles 26 to dispense fluid through the slot 28 and into the container 5. The slot 28 can be elongated and, as illustrated in FIG. 3F, can be shaped such that numerous nozzles 26 (e.g., a row of nozzles 26) can be aligned with the slot 28 to dispense fluid there through. In some embodiments, the slot 28 may be an opening that extends through the drip tray 24 and may include elevated sides on the surface of the drip tray 24, to prevent fluid in the drip tray 24 from falling into the slot 28. The slot 28 can be shaped in any suitable profile, such as circular, oval, rectangular, etc. Moreover, multiple slots 28 can be provided to cover a plurality of dispensing stations, such as the first and second dispensing stations 6, 7. A rotational motor 29 for rotating the turret assembly 10 is also shown in FIG. 3E.

Figure 3G:
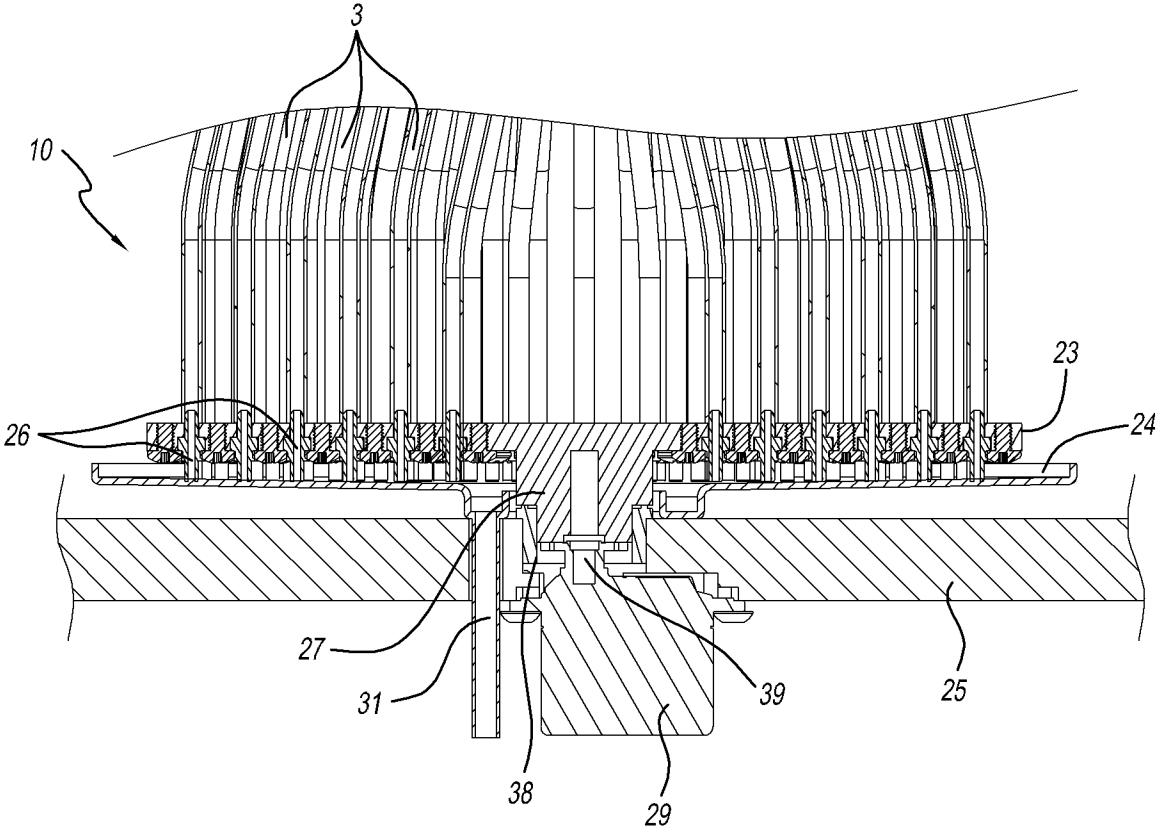
FIG. 3G is a cross-sectional front view of the turret assembly shown in FIGS. 3A-3C and 3E.

FIG. 3G is a cross-sectional front view of the turret assembly 10 shown in FIGS. 3A 3C and 3E. The turret assembly 10 mechanically and operably couples to the rotational motor 29 by means of the hub 27. The hub 27 and motor 29 may be coupled to a mounting bar 25, which can be configured to mechanically support the motor 29 and turret assembly 10. A motor coupling 39 connects the motor 29 with the hub 27 of the turret 23 by passing through an opening in the mounting bar 25. The motor coupling 39 may rigidly couple to the hub 27, such that when the motor coupling 39 is rotated by the motor 29, the hub 27 and turret 23 also rotate. A saddle bearing 38 may be disposed in or near the opening between the hub 27 of the turret 23 and the rotational motor 29. Advantageously, the saddle bearing 38 can protect the rotational motor 29 from vertical loads that may be applied to the motor 29 due in part to the weight of the turret assembly 10. Furthermore, the saddle bearing 38 can isolate and protect the motor 29 from lateral or horizontal loads when the mounting bar 25 is translated by the linear actuator, as discussed below with respect to FIGS. 4A-4B, for example, loads caused by a mild pulling resistance of multiple tubes 3.

Figure 4A:
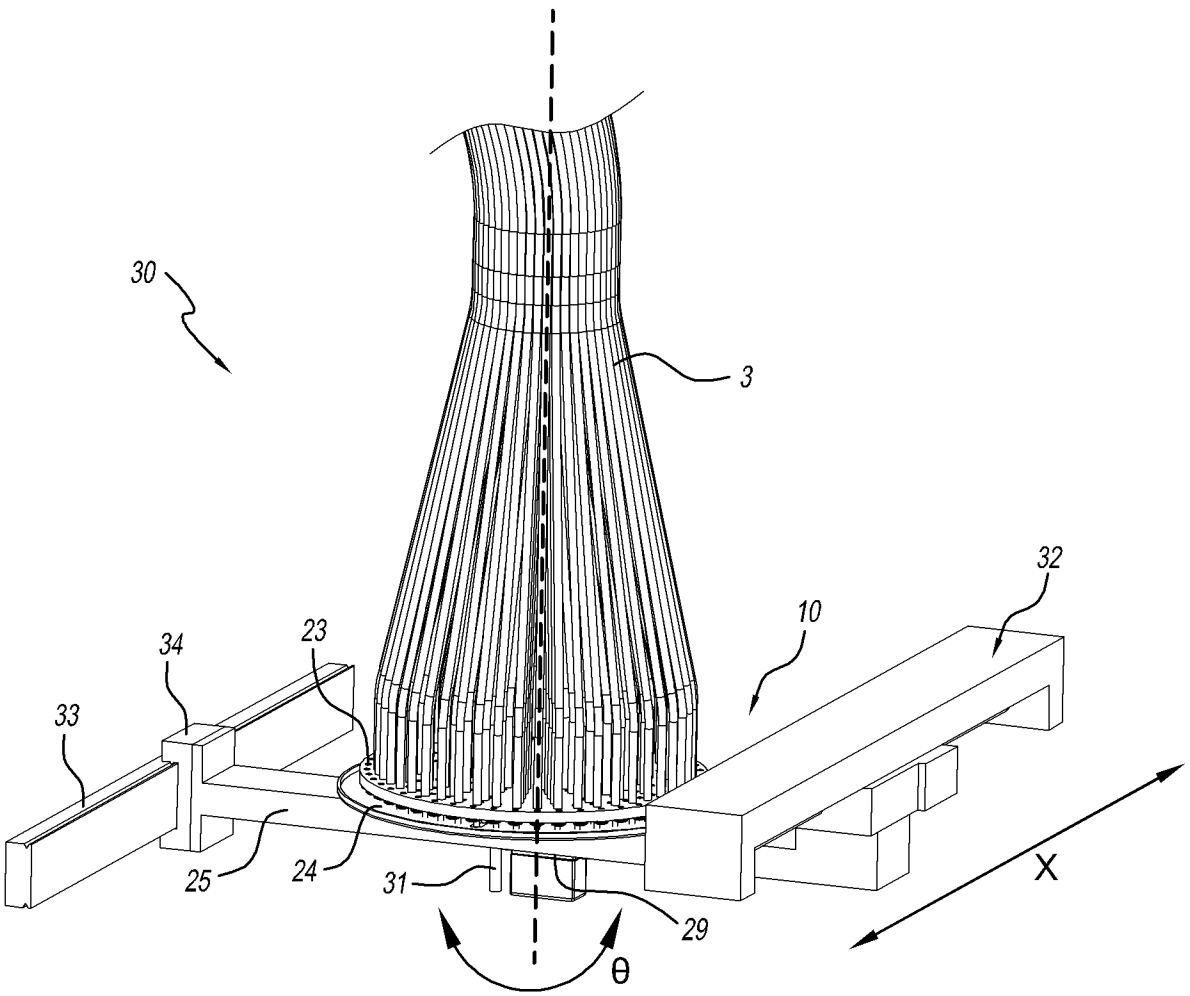
FIG. 4A is a three-dimensional rear, top, perspective front view of an actuation assembly configured to orient the turret assembly at a desired position.
Figure 4B:
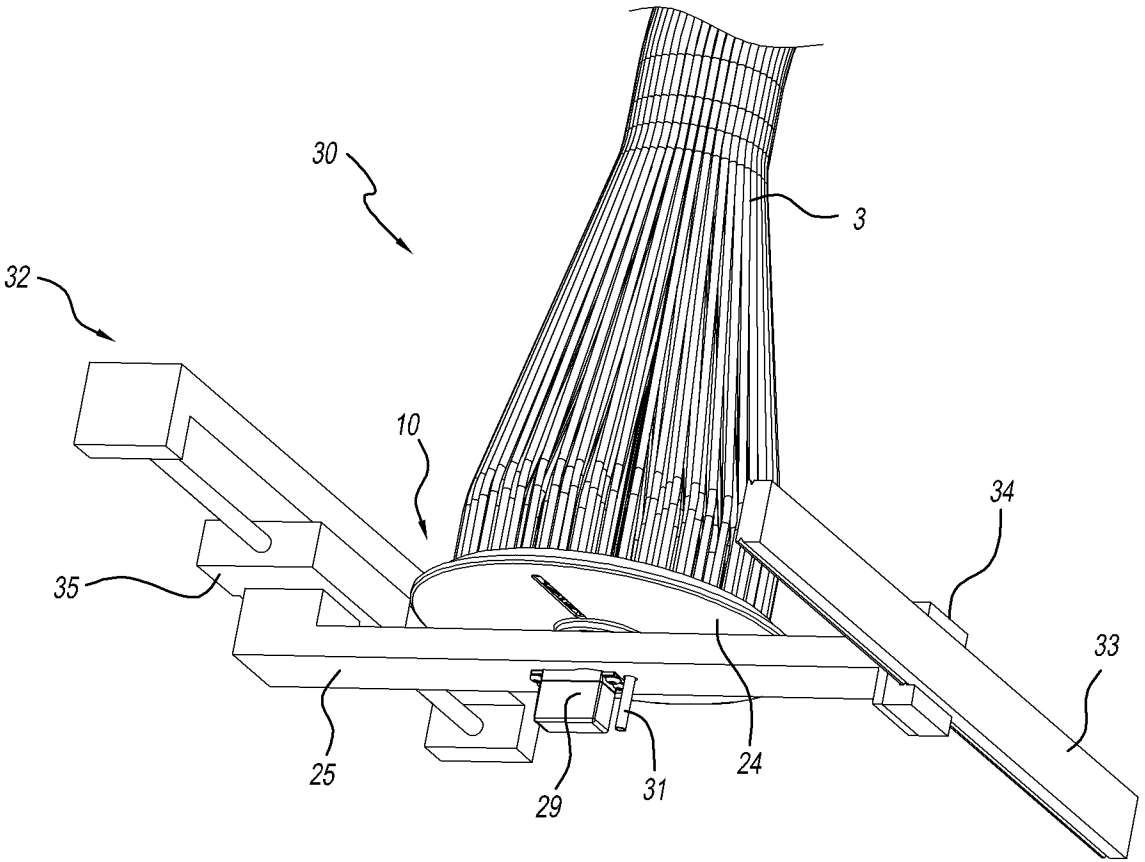
FIG. 4B is a three-dimensional front, bottom, perspective rear view of the actuation assembly of FIG. 4A.

FIG. 4A is a three-dimensional rear, top, right side perspective view of an actuation assembly 30 configured to orient the turret assembly 10 at a desired position. FIG. 4B is a three-dimensional bottom, back left side perspective view of the actuation assembly 30 of FIG. 4A. The actuation assembly 30 is configured to accurately align a selected nozzle 26 with a dispensing station 6, 7 (e.g., FIG. 3A). As discussed herein, it can be advantageous to dispense numerous fluids into a container 5 according to a desired recipe. However, in order to dispense multiple fluids, multiple tubes 3 may also be used. It may difficult to accurately and efficiently manipulate numerous tubes 3 and align the tubes 3 and associated nozzles 26 over the container 5. Advantageously, the two-axis actuation assembly 30 disclosed herein can beneficially address the two dimensional array 45 of nozzles 26 and can align a selected nozzle 26 aligned or in registration with the slot 28 (FIG. 3F) with the dispensing station 6 and container 5 in that station.

The actuation assembly 30 preferably comprises the rotational motor 29 and a linear actuator 32. The rotational motor 29 and the linear actuator 32 may be operably coupled to the mounting bar 25. The rotational motor 29 is adapted to rotate the turret assembly 10 about a rotational axis θ. A selected nozzle 26 in the turret assembly 10 can be controllably positioned at a desired circumferential location by rotating the turret assembly 10 by a suitable angle to orient the turret assembly 10 and a nozzle 26 at the desired circumferential position. In some arrangements, the desired circumferential position of the nozzle 26 can correspond to the circumferential position of the container 5, which has been aligned with the slot 28 (FIG. 3F), e.g., the nozzle 26, the slot 28, and the container 5 can be positioned substantially circumferentially in co-registration about the rotational axis θ. Thus, if a user desires to dispense a fluid that is associated with a nozzle 26 that is away from the dispensing station 6, 7, then the rotational motor 29 can rotate the turret assembly 23 to substantially circumferentially register the nozzle 26 with the slot 28, the container 5 and the dispensing station 6 and/or 7.

The rotational motor 29 may be configured to rotate the turret assembly 10 by any suitable amount (angular degrees). For example, in some embodiments, the rotational motor 29 can rotate the turret assembly 10 over a 360° range. In other embodiments, however, it may be desirable to limit the range by which the rotational motor 29 rotates the turret assembly 10 as described previously. For example, if the turret assembly 10 is rotated by a large angle, the tubes 3 may become tangled, damaged, or stressed. Accordingly, in some embodiments, the angle by which the turret assembly 10 is rotated may be limited. For example, in some embodiments, the rotational motor 29 preferably can rotate the turret assembly over a 180° range, e.g., between +90° and −90°. In some embodiments, the range is about 270° or less, about 180° or less, or most preferably about 120° or less. The rotational motor 29 may be any suitable high-speed, high-torque, motor. In some embodiments, the motor 29 may be a servo motor. In other embodiments, the motor 29 is a stepper motor. Still other types of motors known in the art may be used for the rotational motor 29.

The actuation assembly 30 preferably also includes a linear actuator 32 adapted to translate the turret assembly 10 along a lateral axis x, which may be transverse to the rotational axis θ. The linear actuator 32 includes a suitable linear drive motor. The linear actuator 32 may comprise a rack-and-pinion drive in some embodiments, but in other embodiments, different types of actuators can be used for the linear actuator 32. While the rotational motor 29 circumferentially register a nozzle 26 with a dispensing station 6, 7 and the slot 28 (FIG. 3F) when present, the selected or desired nozzle 26 may nevertheless be laterally (radially) offset from the container 5 and dispensing station 6, 7. Accordingly, the linear actuator 32 can translate the turret assembly 10 to a desired lateral position along the lateral axis x to substantially vertically align the nozzle 26 with the given container 5.

The linear actuator 32 may include a linear slide assembly 35 (FIG. 4B) operably coupled to a first end portion of the mounting bar 25 and a linear support bar 33 operably coupled to a sliding coupler 34 at a second end portion of the mounting bar. The linear actuator 32 translates the turret assembly 10 by activating the linear slide assembly 35 to translate the slide assembly 35 along a lateral rail. The linear slide assembly 35 can thereby cause the mounting bar 25 and turret assembly 10, which is mounted on the mounting bar 25, to translate along the lateral direction x. The sliding coupler 34 at the second end of the mounting bar 25 may rest on the linear support bar 33 and can slide relative to the linear support bar 33 when the mounting bar is translated along the lateral axis x. The turret assembly 10 can thus be translated laterally by a suitable amount as needed to laterally align a particular nozzle 26 with the container 5 and dispensing a station 6 and/or 7.

It is seen, therefore, that the actuation assembly 30 can align any single selected nozzle 26 with a suitable dispensing station 6, 7. This two-axis assembly 30 can advantageously be used to address any nozzle 26 in the 2-D array 45 of nozzles 26 and to accurately and quickly position the nozzle 26 over the container 5 (FIGS. 3A and 4A-4B). By enabling the accurate addressing of numerous nozzles, the actuation assembly 30 enables multiple fluids to be mixed in a container 5 according to a desired recipe. In some situations, the combined rotation driven by the rotational motor 29 and translation driven by the linear actuator 32 may enable registration and then alignment of a particular nozzle 26. However, in other situations, only rotational actuation or only translational actuation may be needed to align a nozzle with the container 5. Thus, the rotational motor 29 can be controllably actuated to rotate the turret 23 and the actuation assembly can translate the turret, thereby to provide wide versatility in the positioning of the turret so as to align any selected one of the nozzles above a selected container at a dispensing station.

Figure 5:
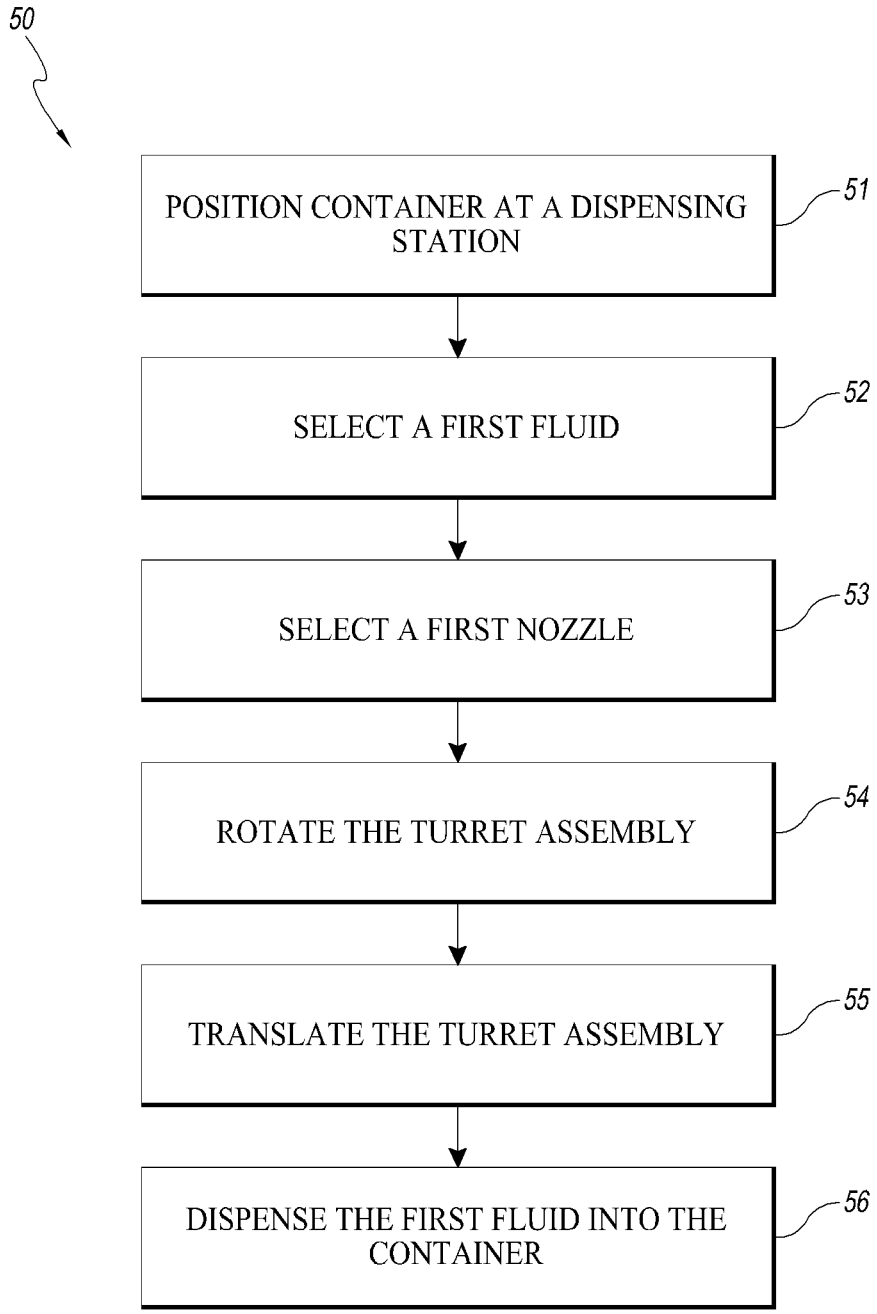
FIG. 5 is a flowchart illustrating a method for dispensing fluid into a container, according to some embodiments.

There also is a method disclosed for forming fluid mixtures. The method is evident from the forgoing descriptions of the systems and apparatus, but is now further elaborated. FIG. 5 is a flowchart illustrating a method 50 for dispensing fluid into a container, according to some embodiments. The method 50 begins in a block 51 to position a container at a dispensing station. As discussed herein, a conveyance system can be used to move containers through the fluid dispensing system. The method moves to a block 52 to select a first fluid to be dispensed into the container. In various embodiments, a user can select a desired mixture, or the user can create his or her own recipe to be mixed in the container. As discussed herein, the user can select or create the recipe on a user interface coupled to the system. For example, the user interface may comprise a touch-screen display or keypad and display that are directly coupled to the system. In other embodiments, the interface may comprise an application or web site connected to the fluid dispensing system over a network, such as the Internet. The instructions containing the recipe can be communicated from a central server to the fluid dispensing system over the network. When the user selects or creates a recipe, the system can determine which fluids are to be mixed and can select a first fluid to be dispensed.

The method continues in a block 53 to select a first nozzle from a plurality of nozzles. The first nozzle can be coupled to a turret assembly having a rotational axis, and the first nozzle can be in fluid communication, and can be associated with, the first fluid. For example, as discussed herein, each nozzle can be in fluid communication with a fluid source reservoir by way of a tube. Each tube and reservoir can convey a particular fluid (e.g., liquid) to be dispensed. Thus, the selected fluid can be associated with the selected nozzle.

Moving to step illustrated in a block 54, the turret assembly can be rotated about the rotational axis to a first circumferential position. In some arrangements, the first circumferential position can be substantially circumferentially aligned with the dispensing station and container. As discussed herein, the selected nozzle may be initially positioned away from the container and dispensing station. Accordingly, it can be advantageous to substantially align the nozzle with the container. In some embodiments, a rotational motor can be used to rotate the turret assembly to the desired circumferential position. For example, the controller can determine an initial position of the selected nozzle and can calculate an angle by which to rotate the first nozzle to bring the first nozzle into substantial circumferential alignment with the dispensing station. The rotational motor, which can be coupled to the turret assembly, can be activated to rotate the turret assembly to the first circumferential position.

The method 50 moves to a block 55, a step of translating the turret assembly to a first lateral position along a lateral axis to substantially laterally align the first nozzle with the dispensing station. While the rotation of block 54 may circumferentially register the first nozzle with a dispensing station, the first nozzle may nevertheless be laterally or radially misaligned or offset from the dispensing station and container. Accordingly, the controller may calculate a lateral displacement by which to translate the first nozzle to bring the first nozzle into substantial vertical alignment with the dispensing station. A linear actuator can be activated to translate the turret assembly by the calculated amount. The rotation step of block 54 and the translation step of block 55 can, alone or in combination (simultaneous or sequential), substantially align the first nozzle with the dispensing station and container.

The method 50 moves to a block 56 to a step of dispensing the first fluid into the container. In some embodiments, the first fluid can be an ingredient in an electronic cigarette (e-cigarette) device. For example, the first fluid can comprise a flavored liquid that can be dispensed into an e-cigarette cartridge that is configured to be coupled to the e-cigarette device. As discussed herein, the nozzle may comprise a check valve in some arrangements. When sufficient pressure is induced across the check valve, the fluid in the tube can be dispensed into the container. Once the first fluid is dispensed in the container, the controller can select a second fluid from the recipe, and the method can repeat until all the fluids from the recipe are dispensed into the container.

In addition, the container and/or the dispensing stations can be sanitized before dispensing fluid. For example, an ultraviolet light can be used to sanitize the container or dispensing station. In addition, a labeling system can be provided to apply a label to the container or print personalized or other information onto a blank or pre-printed pre-affixed set of labels which are part of containers. For example, the printed information can be applied by a laser, a print head, or by a paper and adhesive. Users can design their own labels, or the owner of the system can design the label. Further, a cap can be applied to the container to seal the container. Once the fluid is dispensed, the method may also include a step of measuring the volume or weight of fluid in the container to ensure that an adequate amount of fluid has been dispensed. For example, the fluid can be weighed after each instance in which fluid is dispensed into a container. The method preferably includes mixing the fluid before providing the container to the end user. This may be accomplished by mechanically or acoustically agitating the container.

Although the flowchart of FIG. 5 may illustrate various steps as a sequential process, many of the operations may be performed in parallel, or concurrently. The process can also be repeated, and the order of the operations may be suitably altered or changed. A process may correspond to a method or a procedure that is programmed in a software product to be executed by a processor and stored on a non-transitory computer-readable medium.

Thus, there is provided a method for dispensing fluid into a container, the basic method comprising: positioning a container at a dispensing station, selecting a first fluid to be dispensed into the container, selecting a first nozzle from a plurality of nozzles (the first nozzle coupled to a turret assembly having a rotational axis, the first nozzle in fluid communication with the first fluid), rotating the turret assembly about the rotational axis to a first circumferential position to substantially circumferentially align the first nozzle in registration with the dispensing station, translating the turret assembly to a first lateral position along a lateral axis to substantially laterally align the first nozzle with the dispensing station, and then dispensing the first fluid into the container.

The method preferably further comprises the step of receiving instructions from a central server, the instructions comprising a recipe of multiple fluids to be dispensed into the container. Also, dispensing the first fluid into the container may comprise the step of dispensing a flavored liquid into an electronic cigarette (e-cigarette) cartridge configured to be coupled to an e-cigarette device.

The method preferably further comprises the steps of: selecting a second fluid to be dispensed into the container based at least in part on the recipe, selecting a second nozzle from the plurality of nozzles (the second nozzle coupled to the turret assembly and in fluid communication with the second fluid), rotating the turret assembly about the rotational axis to a second circumferential position to substantially circumferentially align the second nozzle with the dispensing station, translating the turret assembly to a second lateral position along the lateral axis to substantially laterally align the second nozzle with the dispensing station, and then dispensing the second fluid into the container. The step of rotating the turret assembly preferably comprises activating a rotational motor coupled to the turret assembly, and the step of translating the turret assembly preferably comprises activating a linear actuator coupled to the turret assembly. Rotating the turret assembly may comprise activating a rotational motor coupled to the turret assembly, and translating the turret assembly may comprise activating a lead screw or rack-and-pinion motorized system.

The method preferably further comprises: before rotating and translating, the step of determining an initial position of the first nozzle, then calculating an angle by which to rotate the first nozzle to bring the first nozzle into substantial circumferential alignment with the dispensing station, and calculating a lateral displacement by which to translate the first nozzle to bring the first nozzle into substantial lateral alignment with the dispensing station.

The method may further comprise the step applying a cap to the container after dispensing the first fluid, and/or the step of applying or printing a label onto the container, or selectively printing (e.g., by an ink jet printer in the system) additional information onto a pre-printed label previously affixed to the container. The method optionally includes the step of determining a quantity of fluid dispensed into the container by measuring a weight of fluid in the container. The method may also include sanitizing the container before dispensing the first fluid.

Various methods described herein may be embodied in and automated by the use of computer program products, which may include one or more software modules. The software modules can include computer-readable instructions for executing the methods described herein, and can be stored in any suitable type of non-transitory computer storage medium (e.g., RAM, flash memory, ROM, EPROM, EEPROM, hard disks, removable disks, CD-ROM, or any other suitable storage medium). The storage medium can be in electrical communication with one or more processors configured to implement the methods encoded in the computer-implemented instructions. The disclosed methods can be performed with a general purpose processor, Application Specific Integrated Circuit (ASIC), field programmable gate array (FPGA), digital signal processor (DSP), or any other programmable logic device, and in any combination of computing devices. For example, the controller described in the systems disclosed herein can include a processor and/or computer storage media, and can be programmed to implement the methods disclosed herein. For example, in some embodiments, open source micro-controllers such as an Arduino® micro-controller, a BEAGLE board, or RASPBERRY PI microcontroller, may be used to control various components of the system. Furthermore, the controllers disclosed herein can be commanded wirelessly (e.g., by way of WLAN, Bluetooth, etc.) and/or over a network.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while several variations of the invention have been shown and described in detail, other modifications, which are within the scope of this invention, will be readily apparent to those of skill in the art based upon this disclosure. It is also contemplated that various combinations or sub-combinations of the specific features and aspects of the embodiments may be made and still fall within the scope of the invention. It should be understood that various features and aspects of the disclosed embodiments can be combined with, or substituted for, one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A fluid management system comprising a fluid dispensing system, the fluid dispensing system comprising:

a turret assembly comprising a turret having one or more outlets configured to dispense fluid therethrough;

one or more dispensing stations adapted to receive a container to be at least partially filled by fluid passing through the one or more outlets;

an actuation assembly configured to substantially align a selected outlet of the one or more outlets with the container when the container is positioned at a first dispensing station of the one or more dispensing stations, said actuation assembly comprising:

a rotational motor adapted to rotate the turret assembly about a rotational axis; and a linear actuator adapted to translate the turret assembly along a lateral axis, the lateral axis transverse to the rotational axis;

a conveyance system configured to move containers through the one or more dispensing stations; and a controller configured to control the operation of one or more of the turret assembly, the actuation assembly, and the conveyance system.

2. The fluid management system of claim 1, further comprising one or more containers adapted to be received in the one or more dispensing stations, wherein the container(s) comprise cartridge(s) configured to couple to an electronic cigarette (e-cigarette) device.

3. The fluid management system of claim 1, further comprising a housing comprising a kiosk configured to dispense containers containing fluid adapted to be used in an electronic cigarette (e-cigarette) device or in a container for filling an e-cigarette device.

4. The fluid management system of claim 1, wherein the controller is adapted to receive recipe instructions from a user interface, the recipe instructions comprising a recipe selected or created at least in part by a user.

5. The fluid management system of claim 4, further comprising the user interface, wherein the user interface is coupled to the fluid management system.

6. The fluid management system of claim 4, wherein the recipe instructions are received over a network, and wherein the user interface comprises a terminal in data communication with the network.

7. The fluid management system of claim 4, wherein the controller is configured to process the recipe instructions to determine amounts of each ingredient to be used in the recipe.

8. The fluid management system of claim 7, wherein the controller is configured to determine whether or not sufficient ingredients are available, and to communicate with the user interface to notify the user about whether the system includes sufficient ingredients required for the recipe.

9. The fluid management system of claim 1, further comprising multiple dispensing stations, wherein the controller is configured to dispense fluid into containers at the multiple dispensing stations sequentially or simultaneously.

10. The fluid management system of claim 1, further comprising a labeling system configured to apply a labeling information to the container.

11. The fluid management system of claim 1, further comprising a fluid drive system configured to supply fluid to the fluid dispensing system.

12. The fluid management system of claim 11, wherein the fluid drive system comprises one or more of a pump driven by a motor, an accumulator, a pressure regulator, a sensor configured to measure pressure, a filter, a water separator, and a fluid storage reservoir.

13. The system of claim 1, wherein the one or more outlets comprises a plurality of nozzles spaced apart in a pattern across a lower face of the turret.

14. The system of claim 13, wherein each nozzle comprises a check or metering valve.

15. The system of claim 1, wherein the controller is configured to select a first outlet and controllably position the first outlet proximate the first dispensing station by at least one of:

instructing the rotational motor to rotate the turret assembly to a first circumferential position about the rotational axis; and instructing the linear actuator to translate the turret assembly to a first lateral position along the lateral axis.

16. The system of claim 1, further comprising:

a plurality of tubes;

a plurality of fluid reservoirs, wherein each tube is in fluid communication with a single corresponding outlet of the one or more outlets and is in fluid communication with a single corresponding fluid reservoir.

17. The system of claim 16, wherein each fluid reservoir comprises a flexible plastic bag or pressure vessel for storing fluids.

18. The system of claim 1, wherein the turret is disc-shaped and has a central region and a peripheral region along a boundary of the turret, and wherein the one or more outlets comprise a plurality of outlets spaced apart in a pattern across a lower face of the turret, the pattern comprising a two-dimensional array of outlets, the two dimensional array disposed between the central region and the peripheral region.

19. The system of claim 18, wherein the pattern comprises multiple, circumferentially-spaced sets of outlets, each set of outlets comprising multiple, radially-spaced outlets extending from the central region towards the peripheral region.

20. The system of claim 18, wherein the pattern comprises a hexagonal pattern in which each outlet of the plurality of outlets is disposed adjacent and between six other outlets.

21. The system of claim 1, wherein the turret assembly and the rotational motor are coupled to a mounting bar.

22. The system of claim 21, wherein the rotational motor is coupled to the turret assembly by way of a motor coupling passing through an opening in the mounting bar.

23. The system of claim 21, wherein the linear actuator comprises a linear slide assembly operably coupled to a first end portion of the mounting bar, and wherein a second end portion of the mounting bar is operably coupled to a linear support bar such that the second end portion slides along the linear support bar when the linear slide assembly drives the first end portion of the mounting bar along the lateral axis.

24. The system of claim 23, wherein the linear slide assembly is configured to drive the first end potion along the lateral axis using a lead screw or rack-and-pinion motorized system.

25. The system of claim 1, further comprising a drip tray disposed adjacent the turret and downstream of the one or more outlets.

26. The system of claim 25, wherein the drip tray comprises one or more slots disposed over the first dispensing station, and wherein the apparatus is configured to controllably align a selected outlet over the one or more slots for dispensing fluid from the selected outlet to a container.

27. The system of claim 25, further comprising a drain line providing fluid communication between the drip tray and a waste collection reservoir.

28. The system of claim 1, wherein an inlet end of each outlet is configured to couple to a tube extending from a fluid storage reservoir to a first side of the turret, and wherein an outlet end of each outlet is configured to dispense the fluid away from a second side of the turret, the first side opposite the second side.

29. The system of claim 28, wherein the outlet ends of the one or more outlets comprise a plurality of nozzles spaced apart in a pattern across the second side of the turret.

30. The system of claim 29, wherein the pattern comprises multiple, circumferentially-spaced sets of nozzles, each set of nozzles comprising multiple, radially-spaced nozzles extending from a central region of the second side of the turret towards a peripheral region of the second side of the turret.

31. The system of claim 28, wherein the pattern comprises a hexagonal pattern in which each nozzle of the plurality of nozzles is disposed adjacent and between six other nozzles.

32. The system of claim 28, further comprising a drip tray spaced apart from the second side of the turret, the drip tray disposed downstream of the plurality of nozzles and comprising one or more slots defined therethrough.

33. The system of claim 28, further comprising a hub extending outwardly from the second side of the turret, the hub adapted to operably couple with the rotational motor.

* * * * *